US008823590B2

(12) United States Patent
Tseng

(10) Patent No.: US 8,823,590 B2
(45) **Date of Patent: *Sep. 2, 2014**

(54) WIDEBAND ANTENNA

(75) Inventor: Kuan-Hsueh Tseng, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 296 days.

This patent is subject to a terminal disclaimer.

(21) Appl. No.: 12/904,125
(22) Filed: Oct. 13, 2010
(65) Prior Publication Data

US 2012/0019415 A1 Jan. 26, 2012

(30) Foreign Application Priority Data

Jul. 22, 2010 (TW) ..... 099124153 A

(51) Int. Cl.
*H01Q 1/38* (2006.01)
*H01Q 9/42* (2006.01)
*H01Q 1/24* (2006.01)
*H01Q 5/00* (2006.01)

(52) U.S. Cl.
CPC ..... *H01Q 1/243* (2013.01); *H01Q 9/42* (2013.01); *H01Q 1/38* (2013.01); *H01Q 5/001* (2013.01); *H01Q 5/0017* (2013.01)
USPC ..... 343/700 MS; 343/846; 343/702

(58) Field of Classification Search
CPC ..... H01Q 1/243; H01Q 1/38; H01Q 5/001; H01Q 9/42
USPC ..... 343/700 MS, 702, 846
See application file for complete search history.

(56) References Cited

U.S. PATENT DOCUMENTS

| | | | | |
|---|---|---|---|---|
| 6,091,366 | A * | 7/2000 | Zhang et al. | 343/700 MS |
| 6,404,394 | B1 * | 6/2002 | Hill | 343/702 |
| 7,218,282 | B2 * | 5/2007 | Humpfer et al. | 343/700 MS |
| 7,602,341 | B2 | 10/2009 | Wei-Shan et al. | |
| 2009/0046016 | A1 * | 2/2009 | Tseng et al. | 343/700 MS |
| 2012/0032866 | A1 * | 2/2012 | Chen | 343/846 |

* cited by examiner

*Primary Examiner* — Robert Karacsony
*Assistant Examiner* — Amal Patel
(74) *Attorney, Agent, or Firm* — Winston Hsu; Scott Margo

(57) ABSTRACT

A wideband antenna for a radio transceiver device includes a first radiating element for transmitting and receiving wireless signals of a first frequency band, a second radiating element for transmitting and receiving wireless signals of a second frequency band, a grounding unit, a shorting unit having one end electrically connected to the first radiating element and the second radiating element, and another end electrically connected to the grounding unit, and a feeding board including a first feeding metal plane for transmitting wireless signals of the first frequency band and the second frequency band, a second feeding metal plane electrically connected to the second radiating element, and a metal strip electrically connected between the first radiating element and the second radiating element.

6 Claims, 30 Drawing Sheets

| Frequency (MHz) | Efficiency (%) | Frequency (MHz) | Efficiency (%) |
|---|---|---|---|
| 824 | 47.83 | 1785 | 54.43 |
| 836 | 51.13 | 1805 | 50.12 |
| 849 | 52.08 | 1840 | 53.72 |
| 869 | 50.25 | 1850 | 52.41 |
| 880 | 54.12 | 1880 | 54.14 |
| 894 | 54.17 | 1920 | 53.06 |
| 915 | 48.81 | 1950 | 52.92 |
| 925 | 42.52 | 1960 | 51.97 |
| 940 | 40.48 | 1990 | 46.12 |
| 960 | 37.07 | 2110 | 39.81 |
| 1710 | 44.01 | 2140 | 42.15 |
| 1750 | 48.48 | 2170 | 41.58 |

FIG. 3E

| Frequency (MHz) | Efficiency (%) | Frequency (MHz) | Efficiency (%) |
|---|---|---|---|
| 824 | 47.17 | 1710 | 43.32 |
| 836 | 45.61 | 1750 | 42.59 |
| 849 | 48.47 | 1785 | 49.55 |
| 869 | 57.30 | 1805 | 53.62 |
| 880 | 59.19 | 1840 | 53.82 |
| 894 | 57.53 | 1850 | 53.94 |
| 900 | 52.95 | 1880 | 54.30 |
| 915 | 49.19 | 1910 | 54.24 |
| 925 | 49.09 | 1920 | 52.48 |
| 940 | 54.55 | 1930 | 50.80 |
| 960 | 48.84 | 1950 | 47.56 |
| | | 1960 | 46.80 |
| | | 1980 | 44.88 |
| | | 1990 | 44.53 |
| | | 2110 | 46.89 |
| | | 2140 | 50.79 |
| | | 2170 | 53.93 |

FIG. 6E

WIDEBAND ANTENNA

BACKGROUND OF THE INVENTION

1. Field of the Invention

The present invention relates to a wideband antenna, and more particularly, to a wideband antenna for generating resonance effect via coupling feed-in and direct feed-in methods, so as to combine a wideband characteristic of the coupling feed-in method and a well matching characteristic of the direct feed-in method, to improve high-frequency bandwidth and low-frequency matching simultaneously.

2. Description of the Prior Art

An electronic product having a communication function, such as a laptop computer, a personal digital assistant, etc., uses an antenna to transmit or receive radio waves, so as to transmit or receive radio signals, and access wireless network. Therefore, in order to let a user to access wireless network more conveniently, a bandwidth of an ideal antenna should be extended as broadly as possible within a tolerable range, while a size thereof should be minimized as much as possible, to meet a main stream of reducing a size of the electronic product.

Planar Inverted-F Antenna (PIFA) is an antenna commonly used in a radio transceiver device. As implied in the name, a shape of PIFA is similar to an inverted and rotated "F". PIFA has advantages of low production cost, high radiation efficiency, easily realizing multi-channel operations, etc. However, a bandwidth of PIFA is limited. Thus, in order to improve this disadvantage, the applicant of the present invention has provided a dualband antenna 10 shown in FIG. 1A in U.S. Pat. No. 7,602,341. Comparing to a traditional dualband antenna, the dualband antenna 10 adds a radiation part 12 for providing an extra high frequency resonance mode, such that a high frequency band of the dualband antenna 10 is composed of two resonance modes. FIG. 1B illustrates a schematic diagram of voltage to stand wave ratio (VSWR) of the dualband antenna 10. If the dualband antenna 10 does not add the radiation part 12, the dualband antenna 10 becomes a dualband antenna 20 shown in FIG. 2A. A high frequency bandwidth of the dualband antenna 20 reduces substantially and VSWR of the dualband antenna 20 is shown in FIG. 2B. From the above, the dualband antenna 10 effectively increases the high frequency bandwidth with the two resonance modes. However, the dualband antenna 10 is not suitable for some applications and may affect the antenna characteristic if one of the resonance modes suffers from insufficient bandwidth or frequency shift.

SUMMARY OF THE INVENTION

It is therefore a primary objective of the claimed invention to provide a wideband antenna.

The present invention discloses a wideband antenna for a radio transceiver device which comprises a first radiating element, for transmitting and receiving wireless signals of a first frequency band; a second radiating element, for transmitting and receiving wireless signals of a second frequency band; a grounding unit; a shorting unit, having one end electrically connected between the first radiating element and the second radiating element, and another end electrically connected to the grounding unit; and a feeding board, comprising a first feeding metal plane, for transmitting wireless signals of the first frequency band and the second frequency band; a second feeding metal plane, electrically connected to the second radiating element; and a metal strip, electrically connected between the first radiating element and the second radiating element; wherein the first feeding metal plane is coupled to the shorting unit, and a result generated by projecting the first feeding metal plane on a plane corresponding to the shorting unit overlaps the shorting unit partially.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 3E is a schematic diagram of radiation efficiency of the dualband antenna shown in FIG. 3A.

FIG. 6E is a schematic diagram of radiation efficiency of the wideband antenna shown in FIG. 6A.

DETAILED DESCRIPTION

Figure 3A:
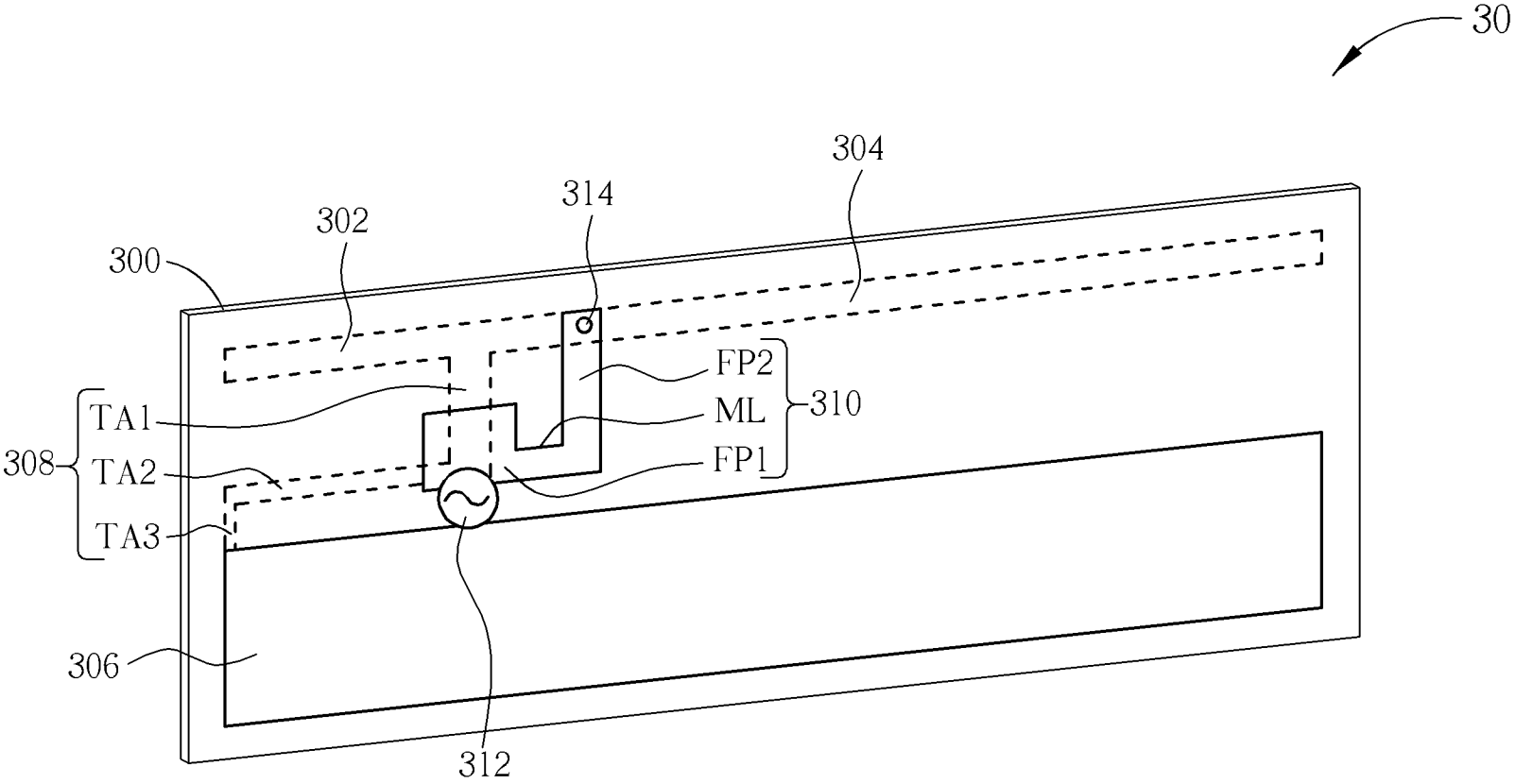
FIG. 3A is a schematic diagram of a wideband antenna according to an embodiment of the present invention.
Figure 3B:
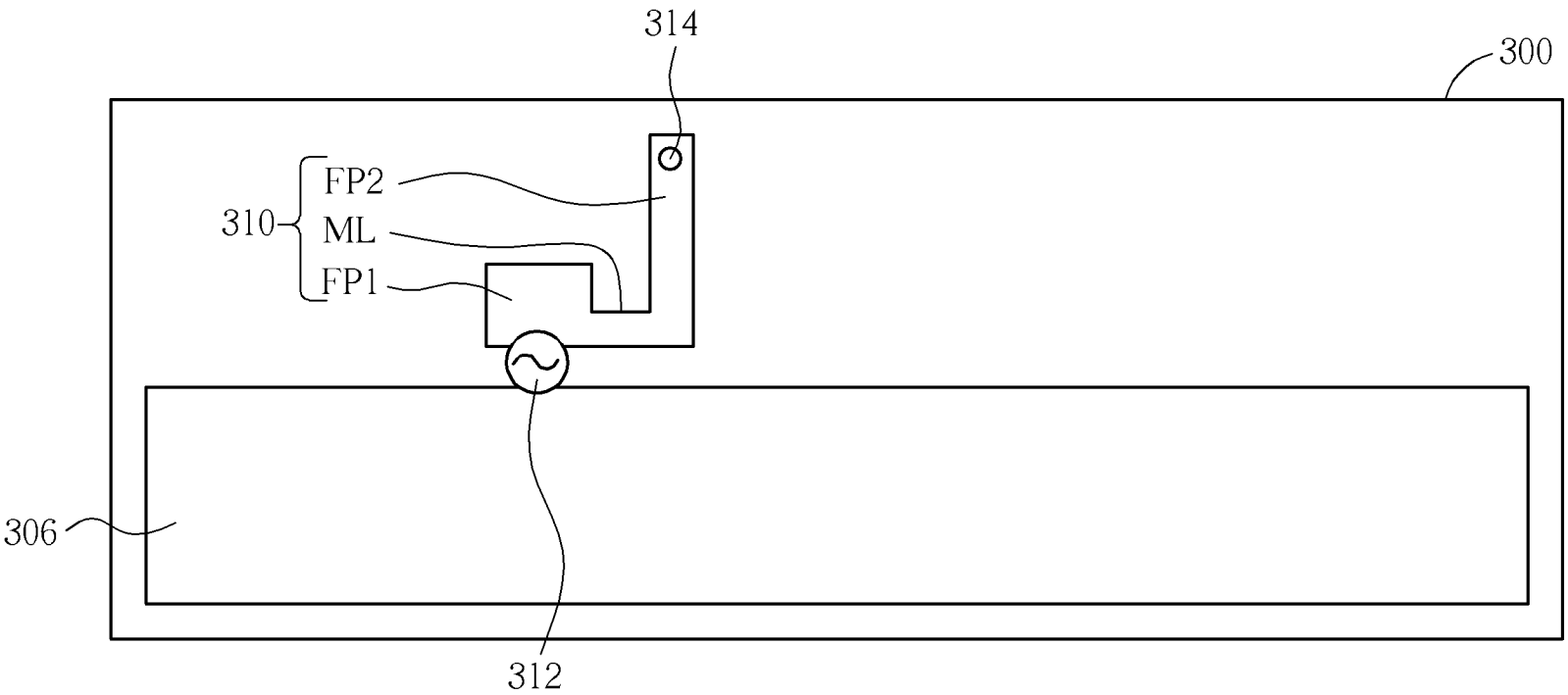
FIG. 3B is a front-view diagram of the wideband antenna shown in FIG. 3A.
Figure 3C:
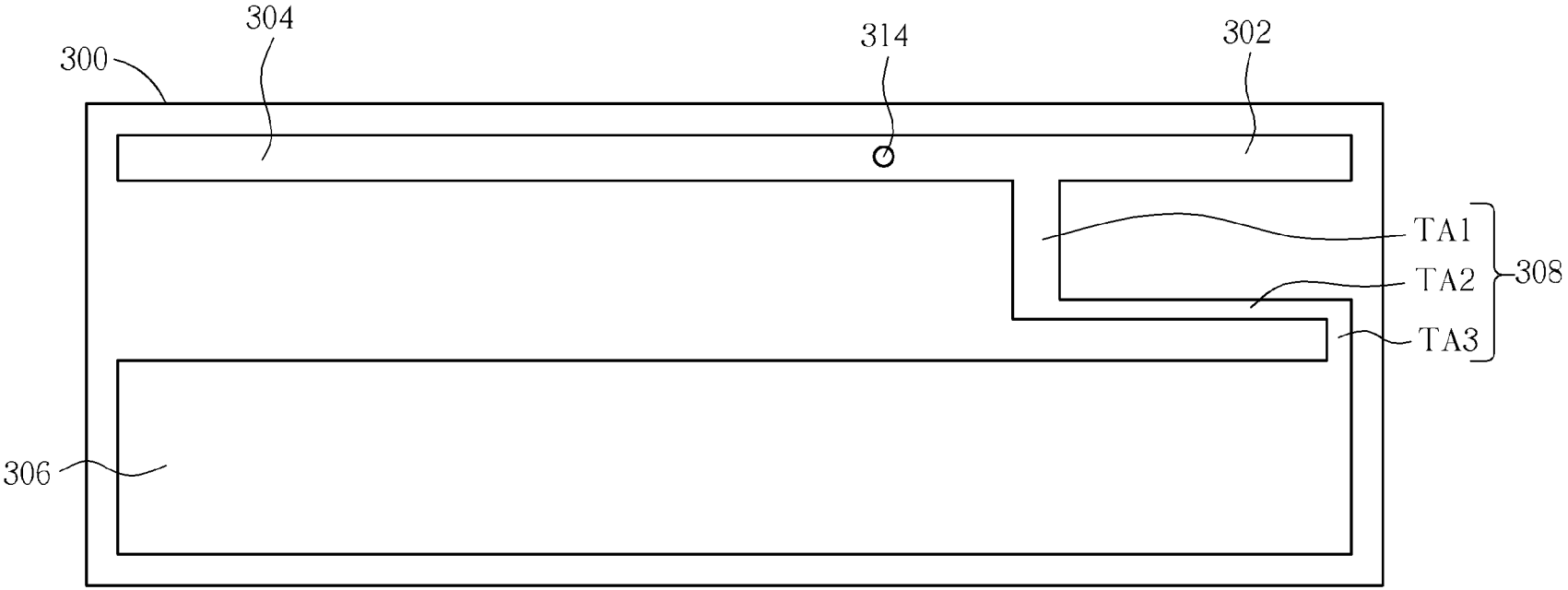
FIG. 3C is a back-view diagram of the wideband antenna shown in FIG. 3A.
Figure 3D:
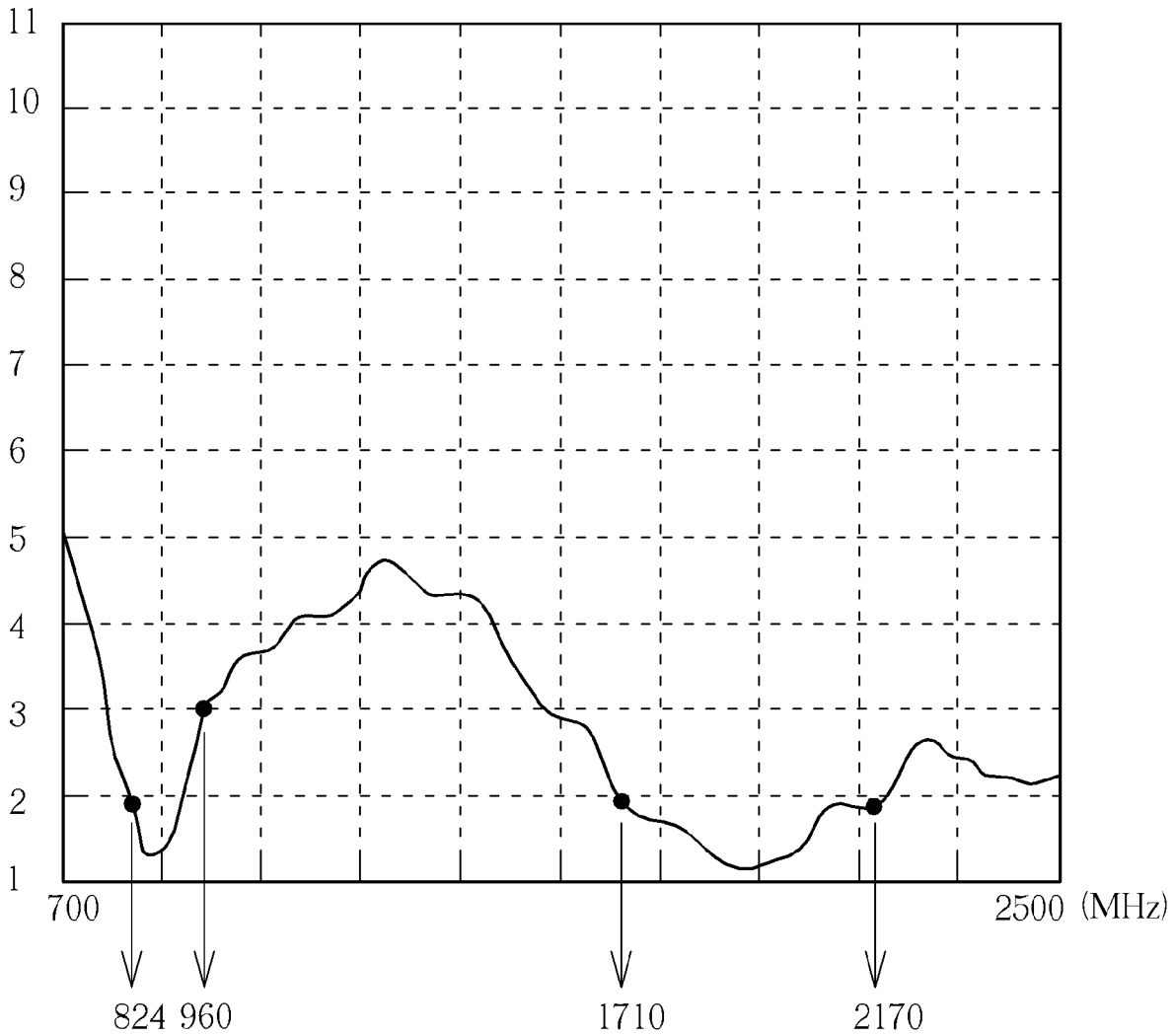
FIG. 3D is a schematic diagram of VSWR of the wideband antenna shown in FIG. 3A.

Please refer to FIG. 3A to FIG. 3E. FIG. 3A is a schematic diagram of a wideband antenna 30 according to an embodiment of the present invention. FIG. 3B is a front-view diagram of the wideband antenna 30. FIG. 3C is a back-view diagram of the wideband antenna 30. FIG. 3D is a schematic diagram of voltage to standing wave ratio (VSWR) of the wideband antenna 30. FIG. 3E is a schematic diagram of radiation efficiency of the wideband antenna 30. The wideband antenna 30 can be applied for a radio transceiver device, and is utilized for transmitting and receiving wireless signals of two different bands (824 MHz~960 MHz and 1710 MHz~2170 MHz). The wideband antenna 30 comprises a substrate 300, a first radiating element 302, a second radiating element 304, a ground unit 306, a shorting unit 308 and a feeding board 310. The substrate 300 is a two-sided circuit board, where the first radiating element 302, the second radiating element 304 and the short unit 306 are disposed on one side, and the feeding board 310 is disposed on the other side. The ground unit 306 is composed of two metal boards connected to each other and the two metal boards are disposed on the two sides of the substrate 300 respectively.

Figure 1A:
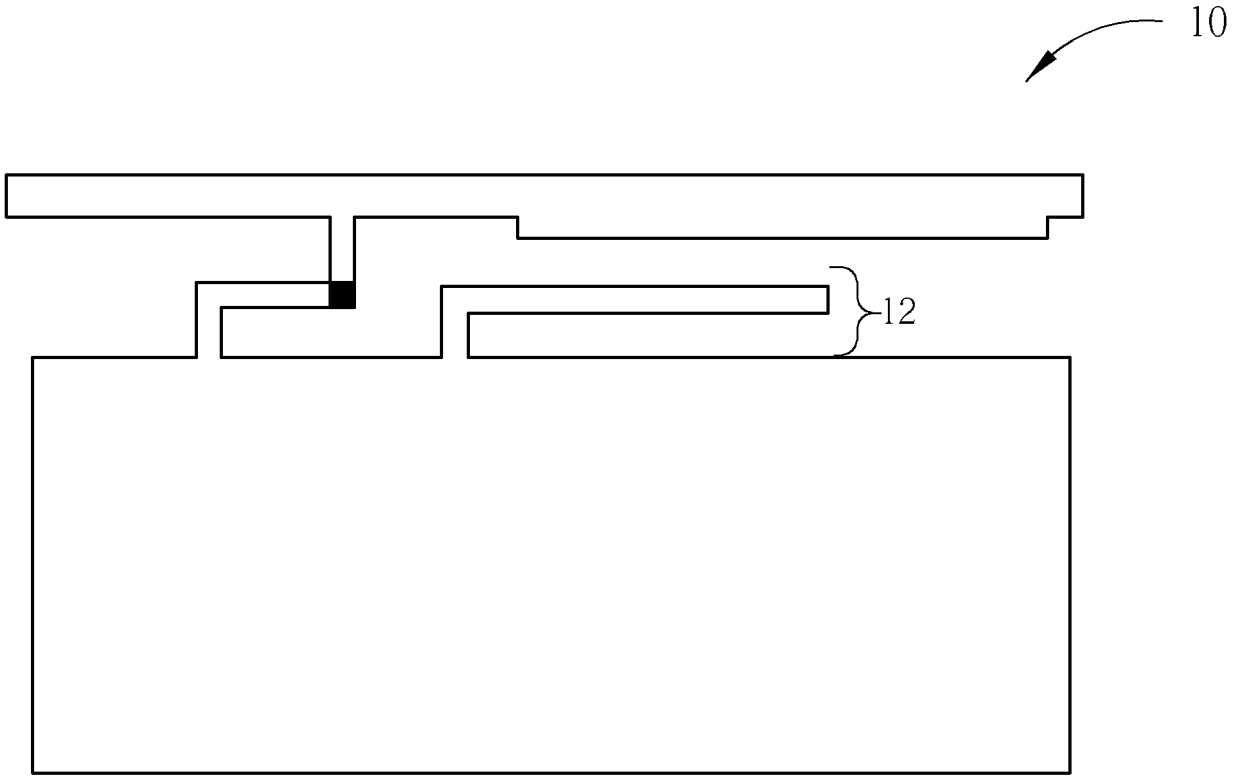
FIG. 1A PRIOR ART
FIG. 1A is a schematic diagram of a dualband antenna according to the prior art.
Figure 1B:
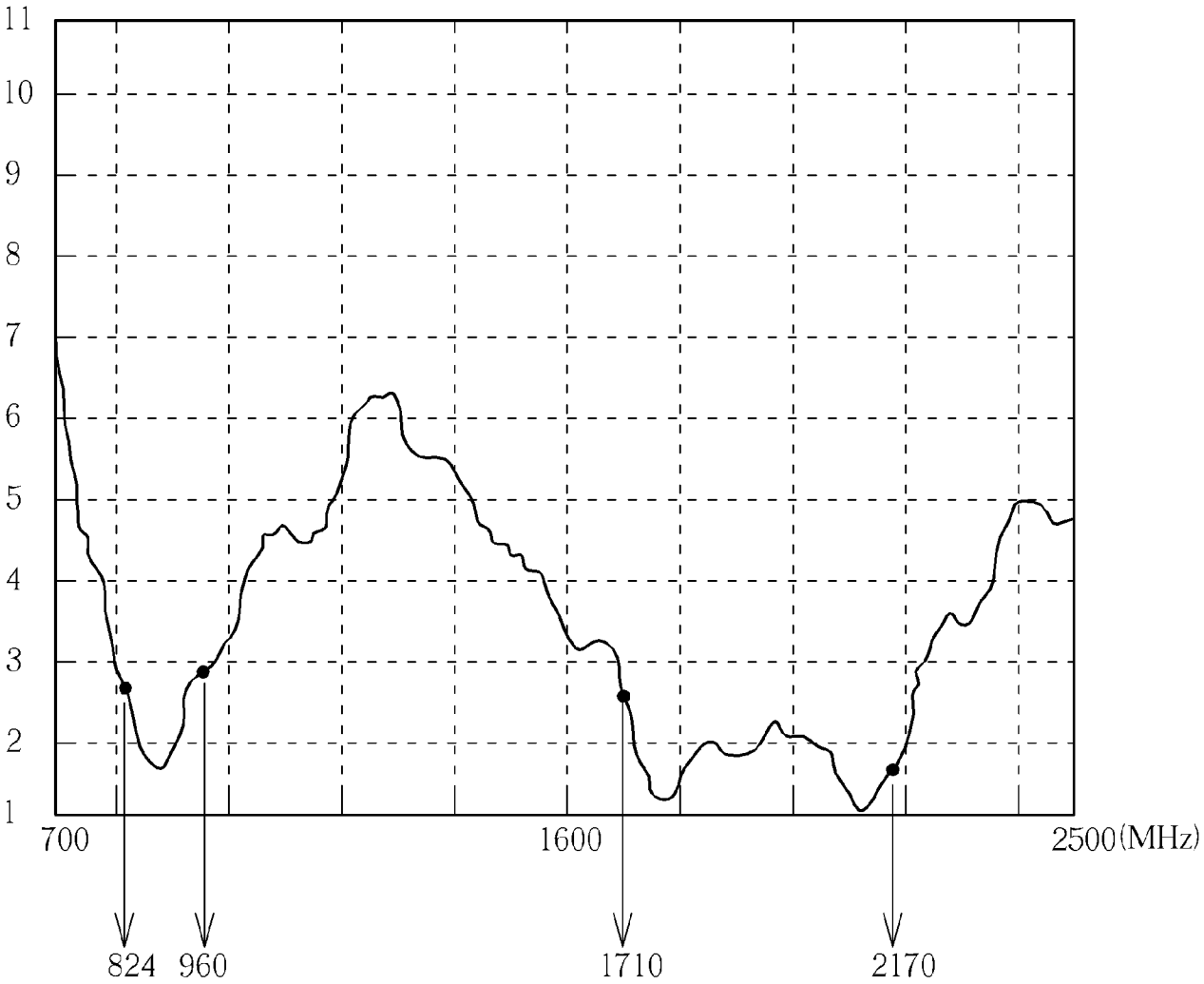
FIG. 1B PRIOR ART
FIG. 1B is a schematic diagram of voltage to standing wave ratio (VSWR) of the dualband antenna shown in FIG. 1A.
Figure 2A:
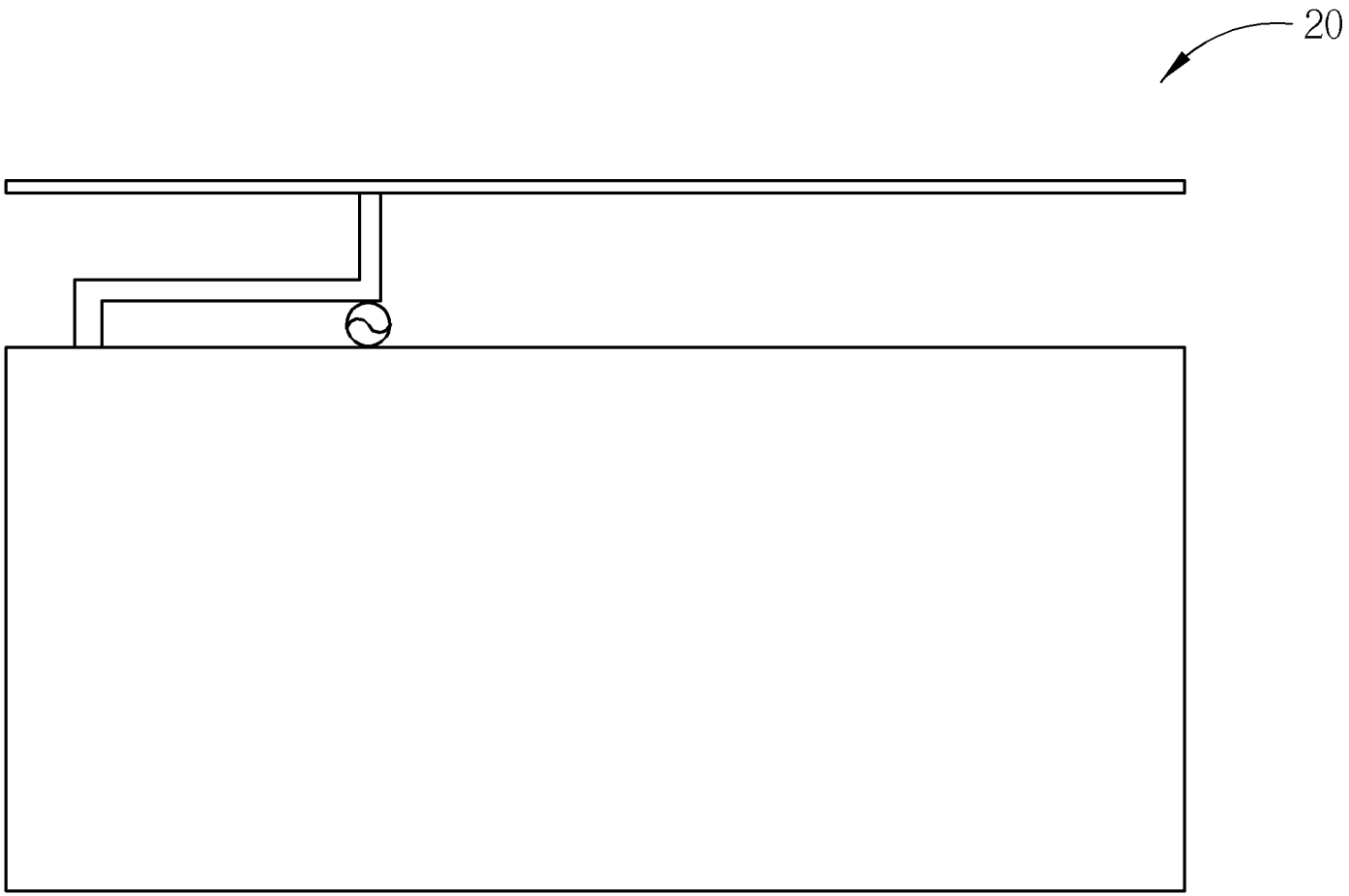
FIG. 2A PRIOR ART
FIG. 2A is a schematic diagram of a dualband antenna according to the prior art.

Comparing FIG. 3C with FIG. 2A, shapes of the radiating elements of the wideband antenna 30 are similar to those of the dualband antenna 20. However, the wideband antenna 30 adds the feeding board 310 in comparison with the dualband antenna 20. The feeding board 310 transmits signals to the short unit 308 by a coupling feed-in method, and transmits signals to the second radiating element 304 by a direct feed-in method. In other words, unlike the dualband antenna 20 which directly conducts signals to the short unit, the wideband antenna 30 utilizes both the coupling feed-in and direct feed-in methods to generate resonance effect, to combine a wideband feature of the coupling feed-in method and a well matching feature of the direct feed-in method, and to improve a high-frequency bandwidth and increase low-frequency matching.

In detail, as shown in FIG. 3A and FIG. 3C, the short unit 308 comprises a first arm TA1, a second arm TA2 and a third arm TA3, and is preferably a monocoque structure. The first arm TA1 extends from a connection place of the first radiating element 302 and the second radiating element 304 toward the grounding unit 306. The second arm TA2 includes one end coupled to the first arm TA1 and another end extending toward the first radiating element 302. The third arm TA3 is coupled to the second arm TA2 and the grounding unit 306. On the other hand, as shown in FIG. 3A and FIG. 3B, the feeding board 310 comprises a first feeding metal plane FP1, a second feeding metal plane FP2 and a metal strip ML, and is preferably a monocoque structure. The first feeding metal plane FP1 includes a signal feeding terminal 312 for connecting a signal wire to transmit wireless signals. The second feeding metal plane FP2 is electrically connected to the second radiating element 304 by a via 314. The metal strip ML is electrically connected between the first feeding metal plane FP1 and the second feeding metal plane FP2. In addition, projecting results of the first feeding metal plane FP1 and the first arm TA1 overlap, meaning that a result generated by projecting the first feeding metal plane FP1 on a plane corresponding to the first arm TA1 overlaps the first arm TA1 partially.

Therefore, after a radio frequency signal is transmitted to the signal feeding terminal 312 on the first feeding metal plane FP1, current flows from the first feeding metal plane FP1, the metal strip ML, the second feeding metal plane FP2 to the second radiating element 304 and the first radiating element 302 through the via 314, and such an operation is the direct feed-in method. In addition, the first feeding metal plane FP1 overlaps the first arm TA1; therefore, via coupling effect, the first arm TA1 inducts current of the first feeding metal plane FP1, and generates an induced current with the same direction, which is the coupling feed-in method. Combining the coupling feed-in and the direct feed-in methods, as shown in FIG. 3D, the wideband antenna 30 can improve bandwidth and matching effect simultaneously. Meanwhile, as shown in FIG. 3E, radiation efficiency in the operating bands (824 MHz~960 MHz and 1710 MHz~2170 MHz) can be maintained around 50%. Advantages and disadvantages related to the coupling feed-in and direct feed-in methods are described as follows.

Figure 2B:
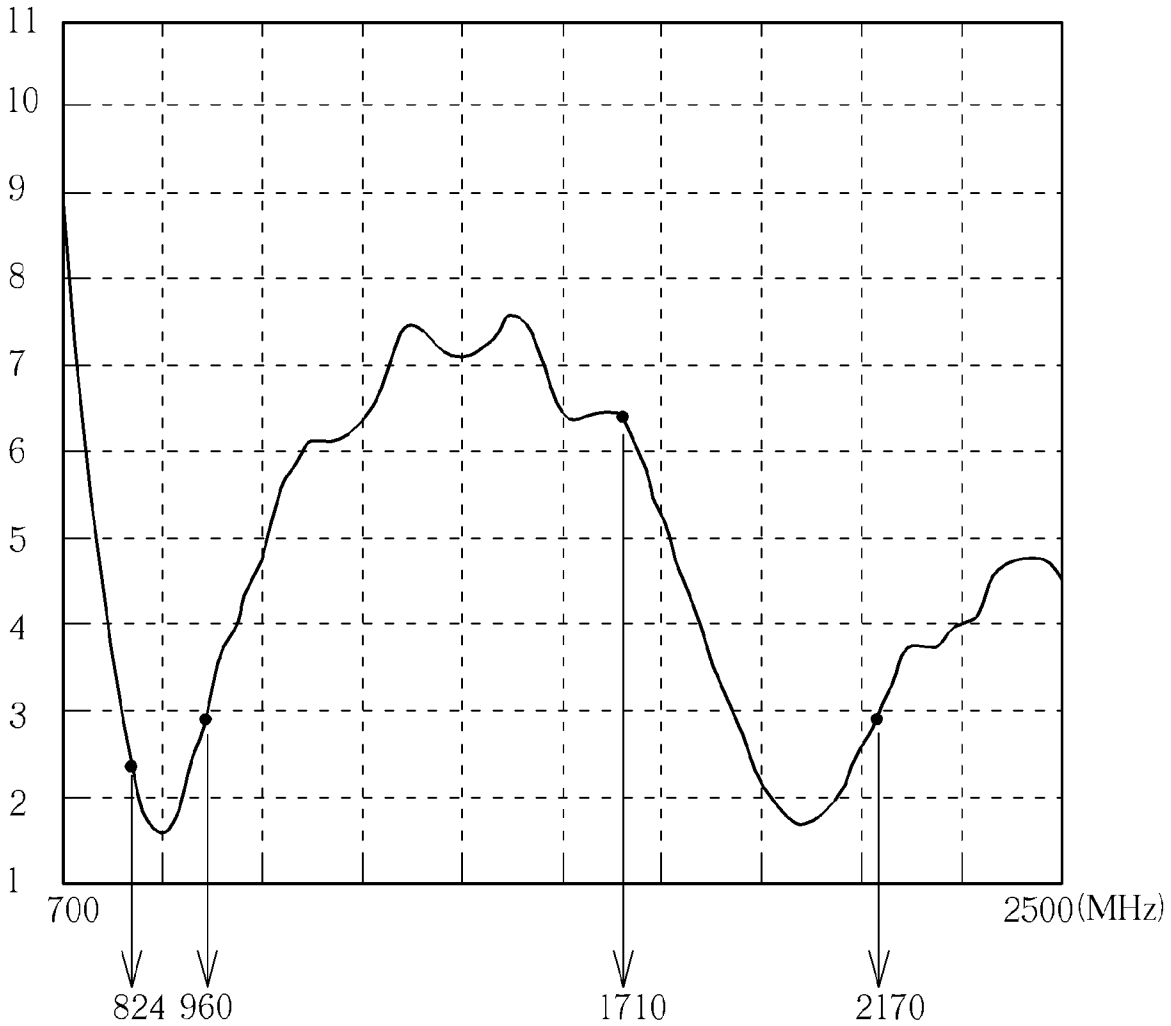
FIG. 2B PRIOR ART
FIG. 2B is a schematic diagram of VSWR of the dualband antenna shown in FIG. 2A.
Figure 4A:
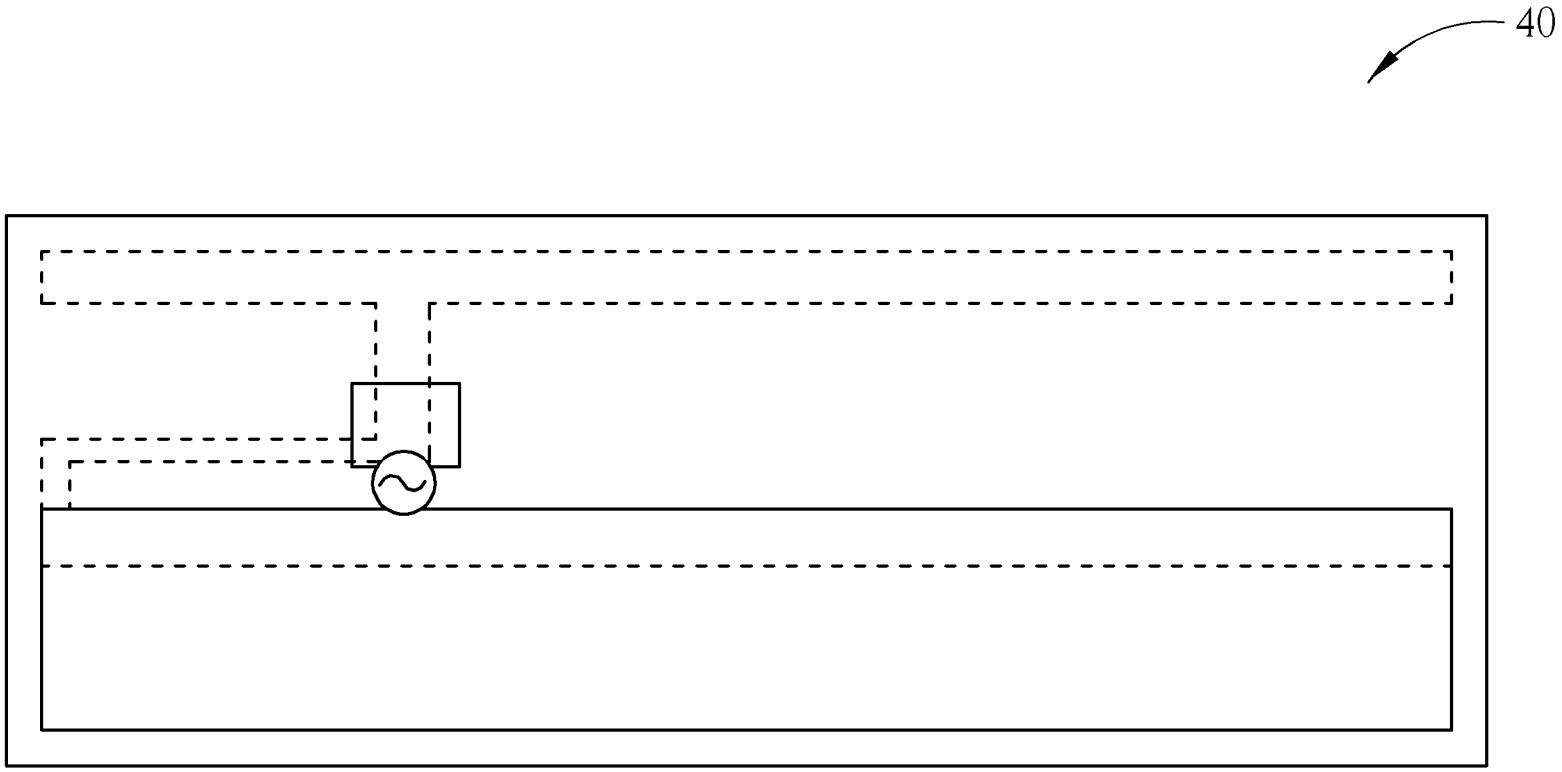
FIG. 4A and FIG. 4B are schematic diagrams of VSWR of an antenna using only a coupling feed-in method.
Figure 4B:
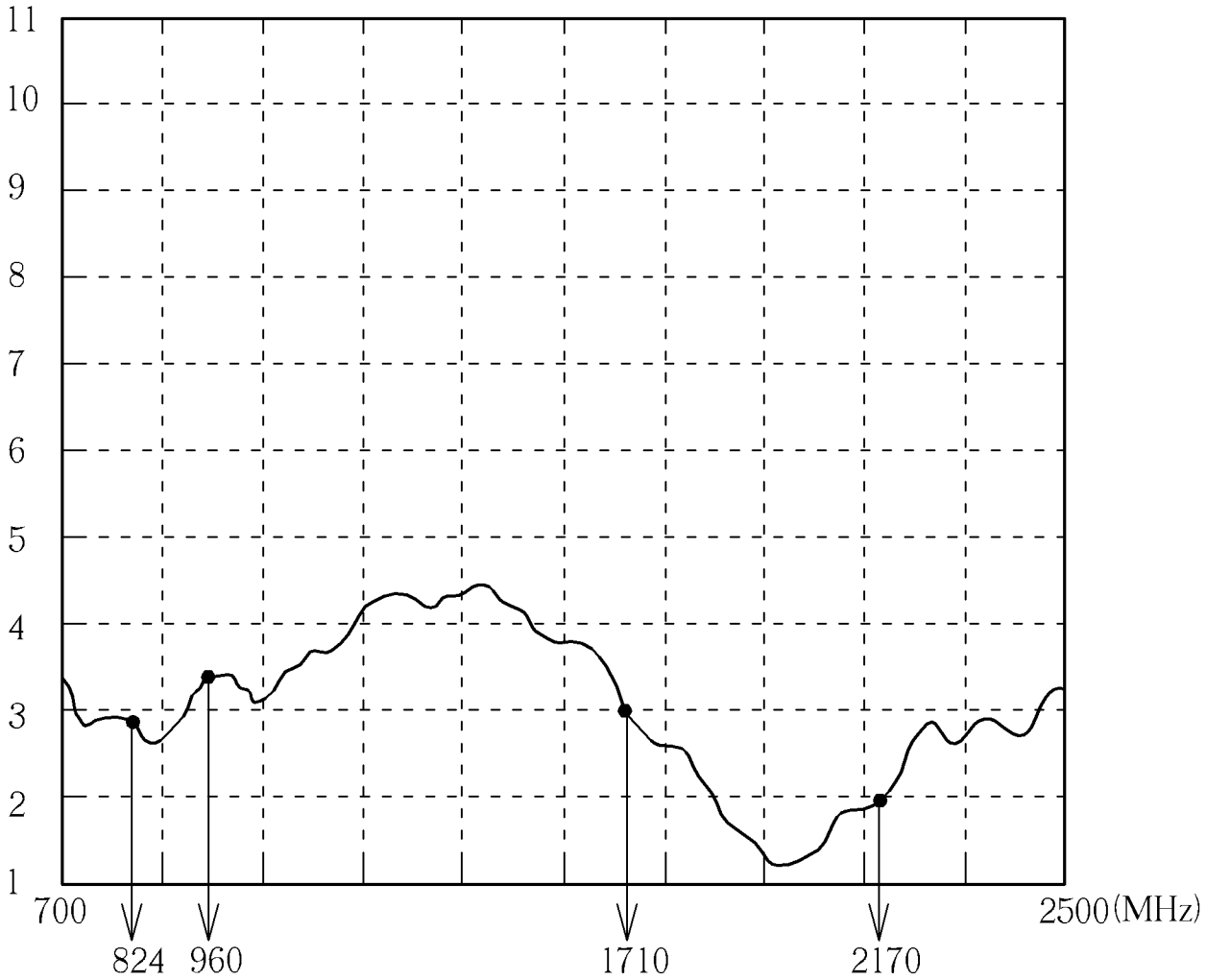
Figure 5A:
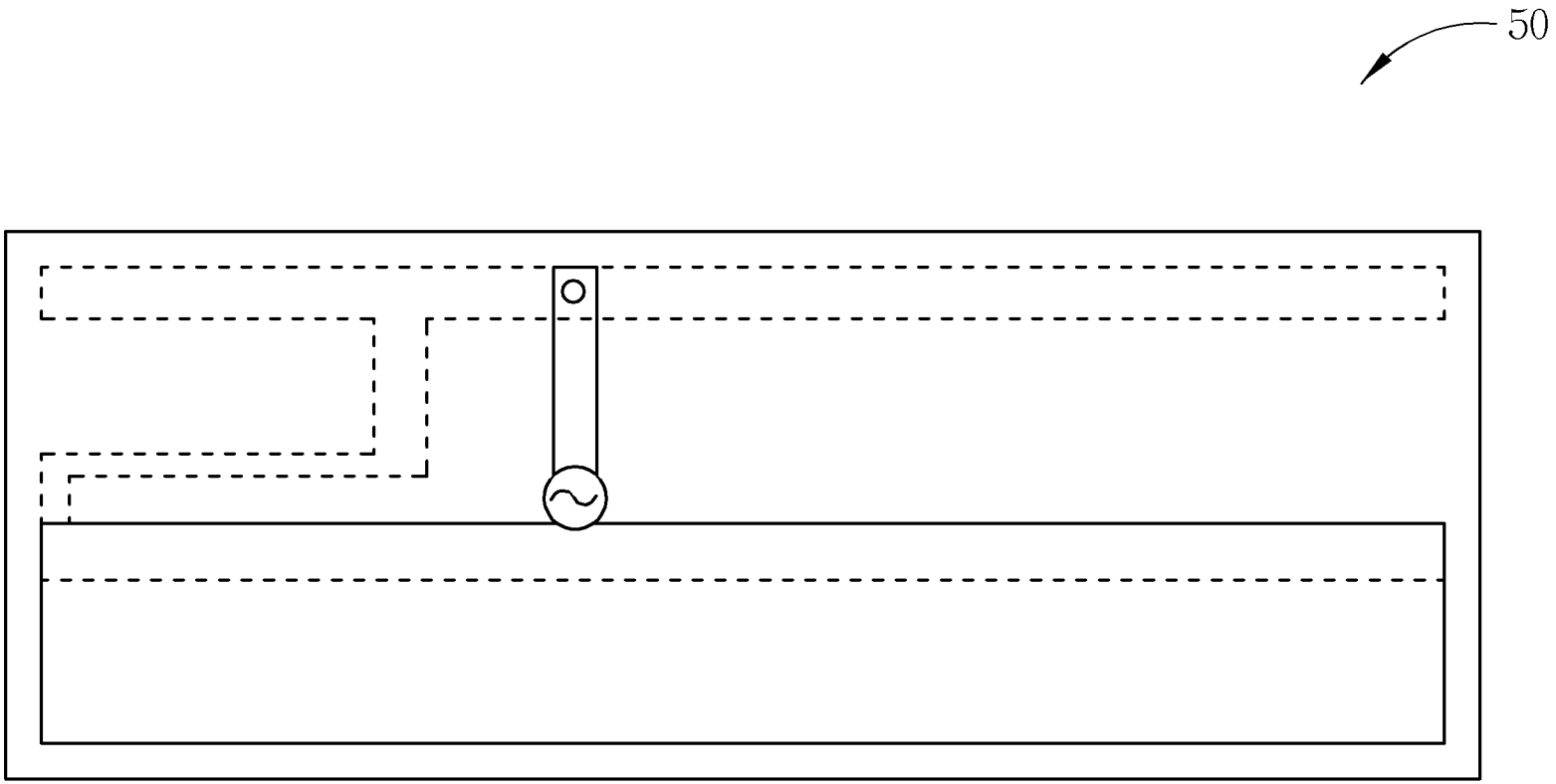
FIG. 5A and FIG. 5B are schematic diagrams of VSWR of an antenna using only a direct feed-in method.
Figure 5B:
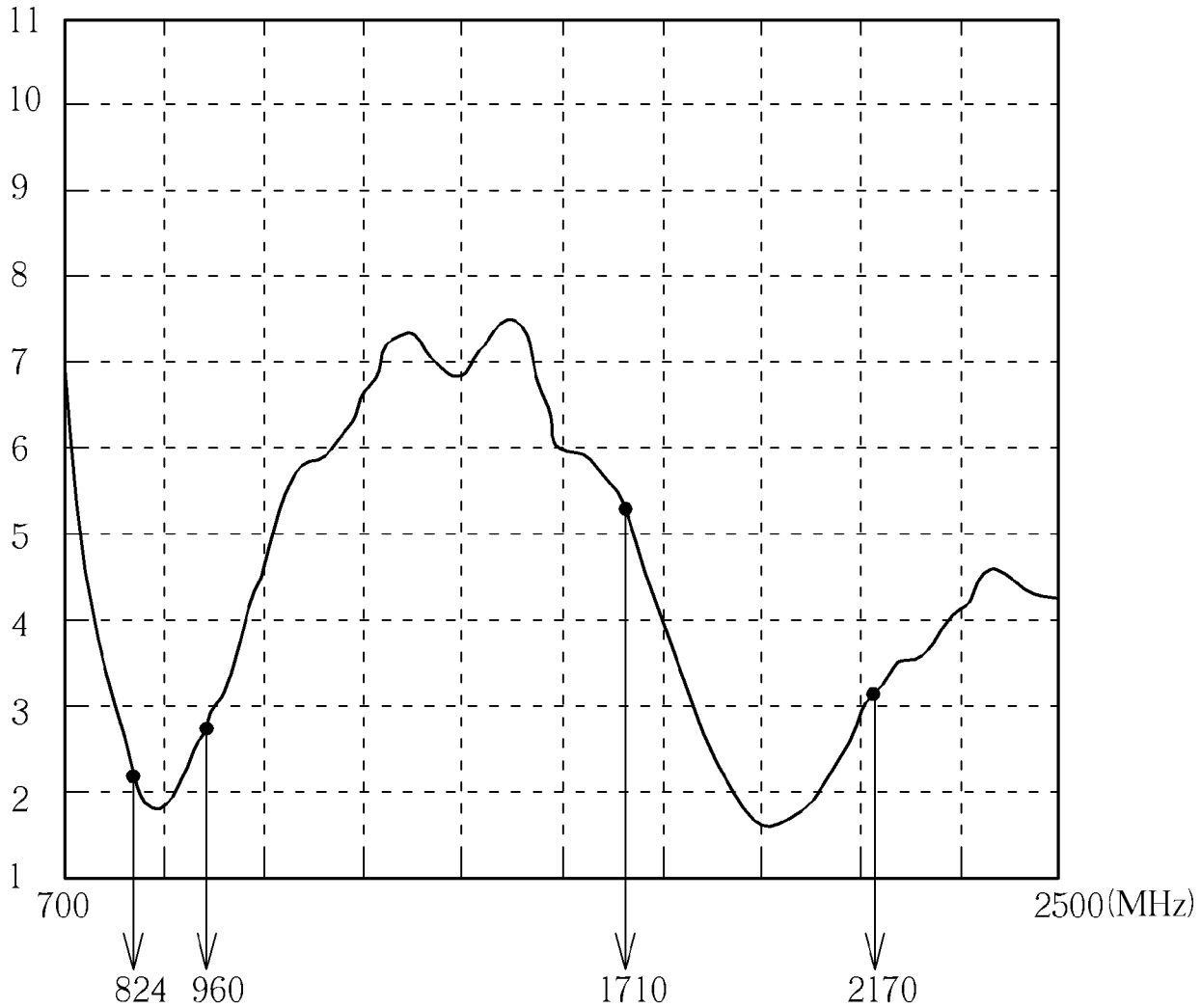

Please refer to FIG. 4A, FIG. 4B, FIG. 5A and FIG. 5B. FIG. 4A and FIG. 4B are schematic diagrams of an antenna 40 and VSWR of the antenna 40 respectively. FIG. 5A and FIG. 5B are schematic diagrams of an antenna 50 and VSWR of the antenna 50 respectively. The antenna 40 equals the wideband antenna 30 without the direct feed-in part, i.e. removing the second feeding metal plane FP2 and the metal strip ML from the wideband antenna 30. On the contrary, the antenna 50 equals the wideband antenna 30 without the coupling feed-in part, i.e. removing the first feeding metal plane FP1 and the metal strip ML from the wideband antenna 30, and moving the signal feeding terminal 312 to the second feeding metal plane FP2. Comparing FIG. 4B and FIG. 5B with FIG. 2B, when only the coupling feed-in method is used, the high-frequency bandwidth is better, but the low-frequency matching is worse; and when only the direct feed-in method is used, the high frequency bandwidth is worse, but the low-frequency matching is better. Therefore, when the coupling feed-in method and the direct feed-in method are used simultaneously, advantages of the two feed-in methods can be combined and eliminate both disadvantages, to reach the goal for improving bandwidth and matching simultaneously.

Note that, the main concept of the present invention is to combine the coupling feed-in method and the direct feed-in method, to improve bandwidth and matching, and those skilled in the art can make alternations and modifications accordingly. For example, in FIG. 3B, each component of the wideband antenna 30 is printed on the substrate 300; however, the first radiating element 302, the second radiating element 304, the ground unit 306, the shorting unit 308 and the feeding board 310 can be made of metal planes without utilizing the substrate 300. No matter how to form the wideband antenna 30, make sure the relation of coupling feed-in between the first feeding metal plane FP1 and the first arm TA1, i.e. both are kept a specific distance and not directly connected to each other, and the relation of direct feed-in between the second feeding metal plane FP2 and the second radiating element 304, i.e. both are directly connected to each other. In addition, except using the via 314 to electrically connect the second feeding metal plane FP2 and the second radiating element 304, other electrical connecting methods can be used.

Figure 6A:
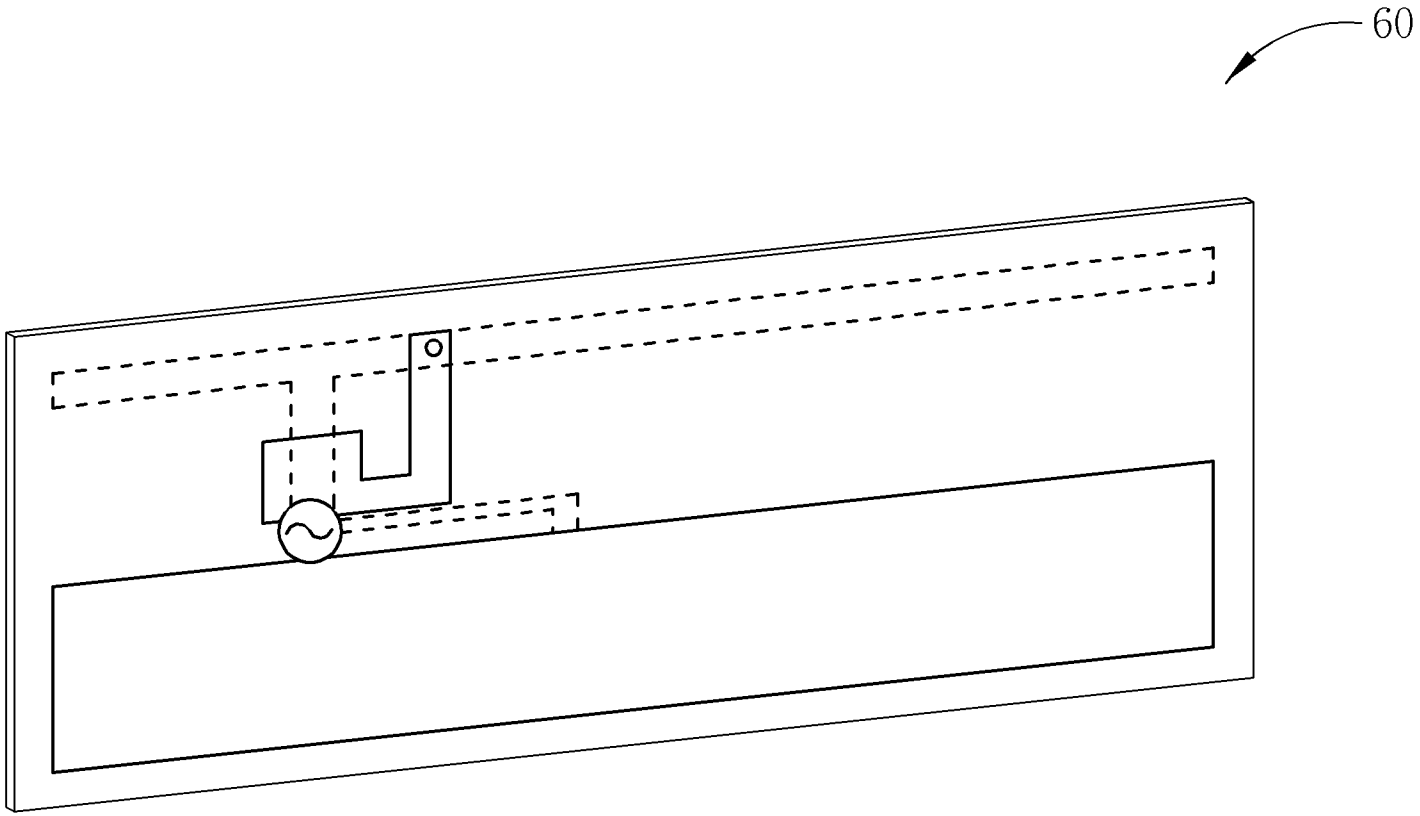
FIG. 6A is a schematic diagram of a wideband antenna according to an embodiment of the present invention.
Figure 6B:
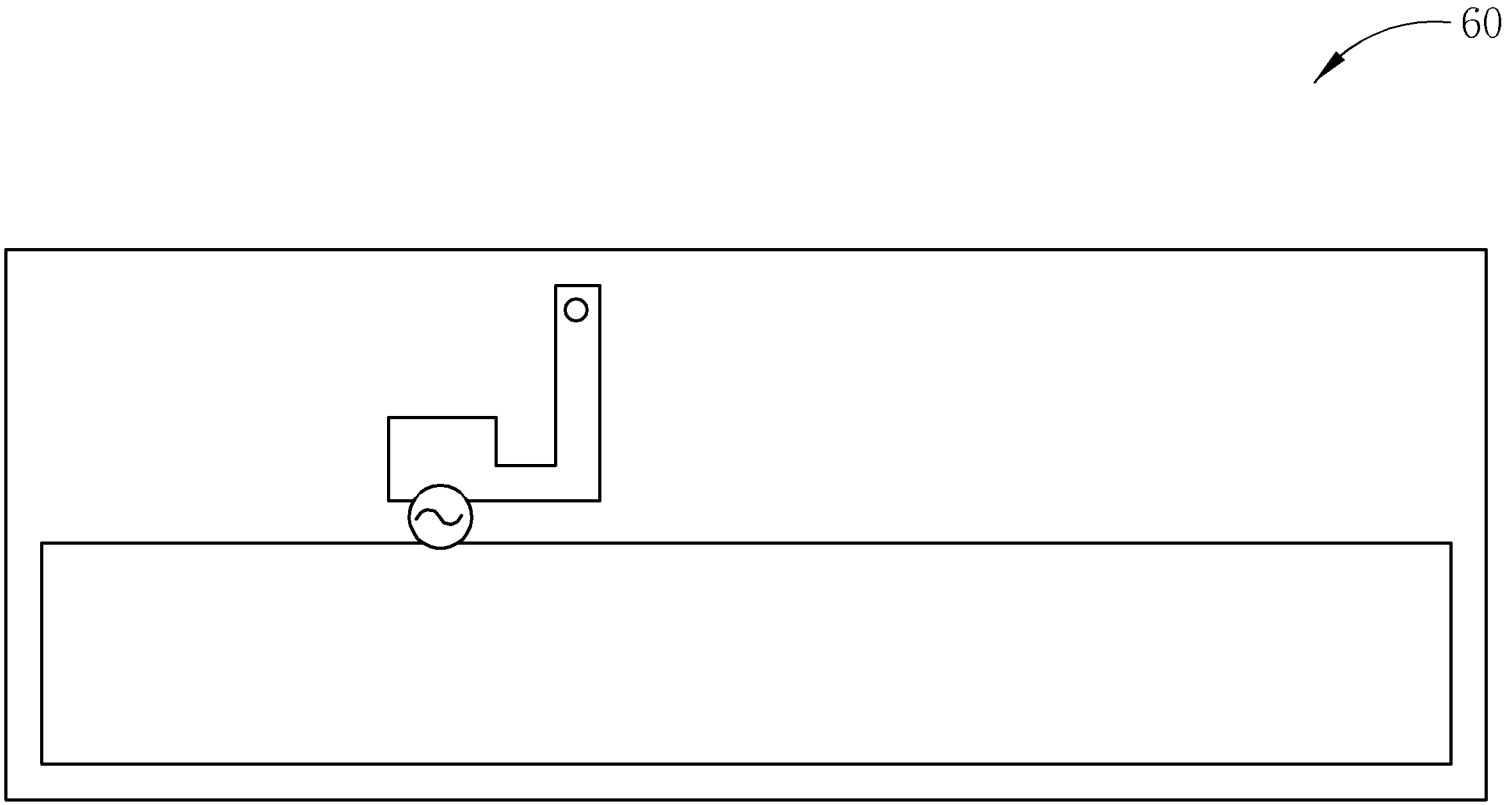
FIG. 6B is a front-view diagram of the wideband antenna shown in FIG. 6A.
Figure 6C:
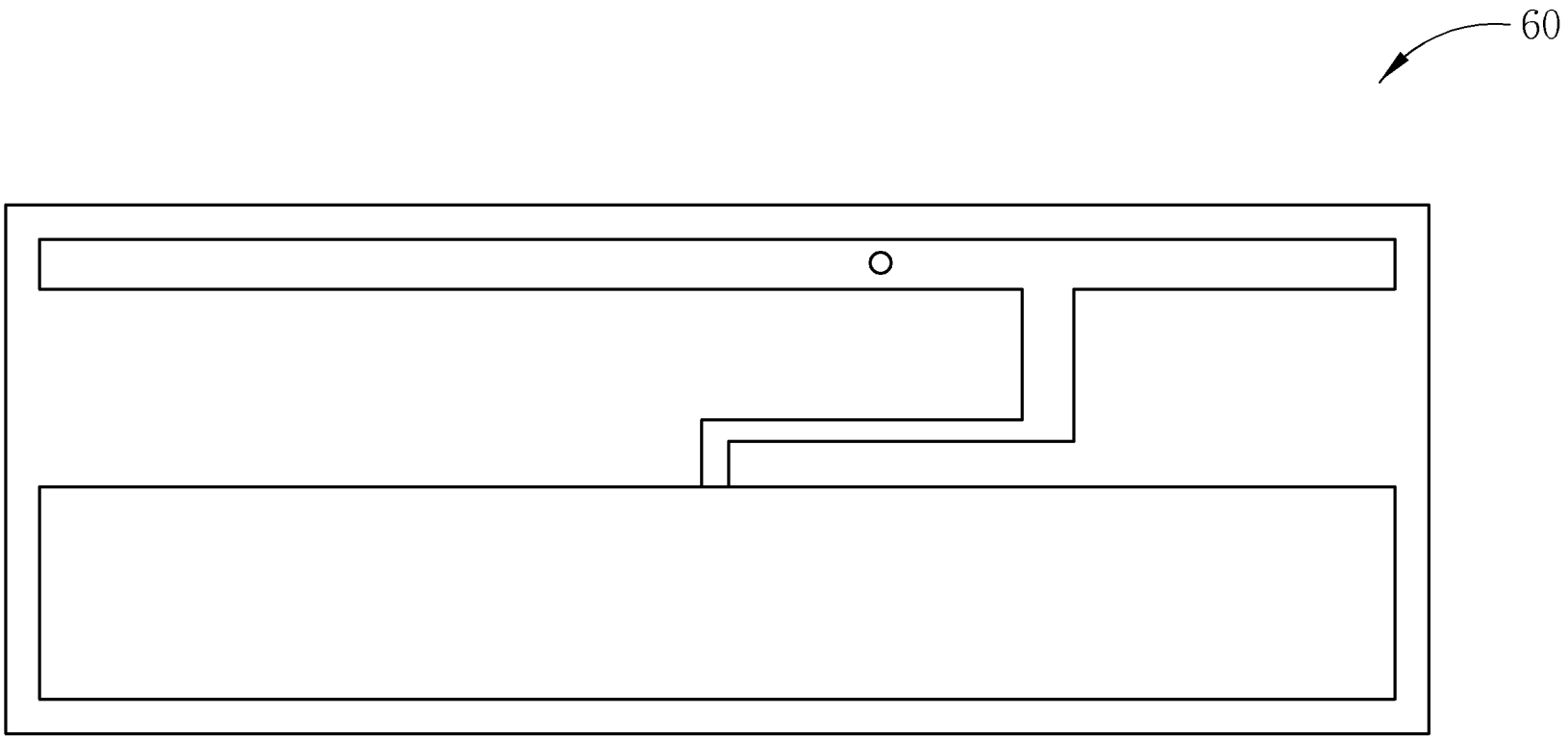
FIG. 6C is a back-view diagram of the wideband antenna shown in FIG. 6A.
Figure 6D:
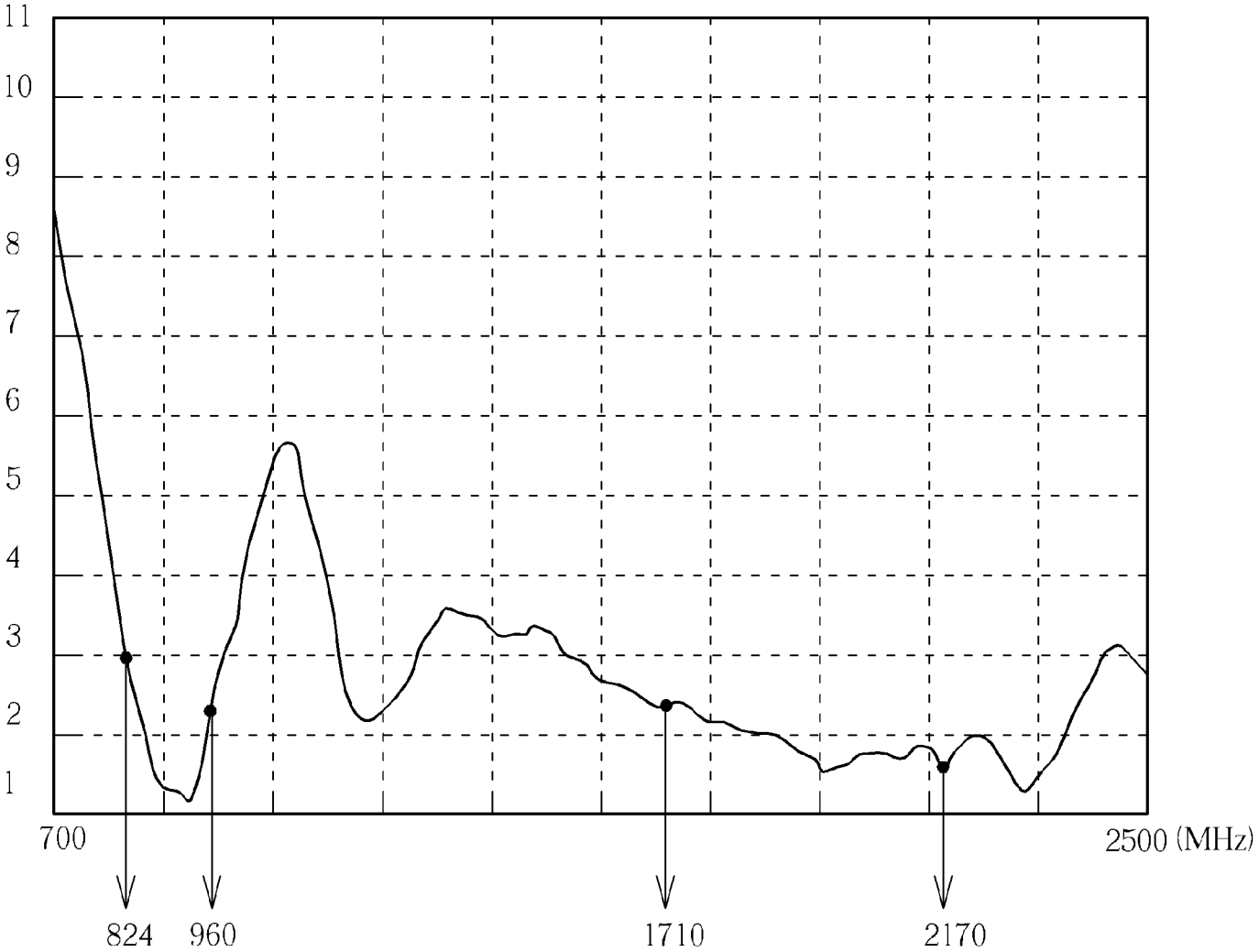
FIG. 6D is a schematic diagram of VSWR of the wideband antenna shown in FIG. 6A.

Furthermore, as well known in the industry, radiation frequency, bandwidth, efficiency, etc. of an antenna are related to a shape, material, etc. of the antenna. For example, in FIG. 3A, the short unit 308 extends toward the high-frequency radiation part (i.e. the first radiating element 302) in the wideband antenna 30; thus, current can be distributed more uniformly on the second radiating element 304 to obtain better omnidirectional radiation. Certainly, as to different applications, the short unit can be designed to extend toward the low frequency radiation part. For example, please refer to FIG. 6A to FIG. 6E. FIG. 6A is a schematic diagram of a wideband antenna 60 according to an embodiment of the present invention. FIG. 6B is a front-view diagram of the wideband antenna 60. FIG. 6C is a back-view diagram of the wideband antenna 60. FIG. 6D is a schematic diagram of VSWR of the wideband antenna 60. FIG. 6E is a schematic diagram of radiation efficiency of the wideband antenna 60. As shown in FIG. 6A to FIG. 6E, difference between the wideband antenna 60 and the wideband antenna 30 shown in FIG. 3A is that the short units of the wideband antenna 60 and the wideband antenna 30 extend toward different directions. Except that, operating methods, especially the combination of coupling feed-in and direct feed-in are the same. Therefore, the wideband antenna 60 can also improve bandwidth and matching.

Figure 7A:
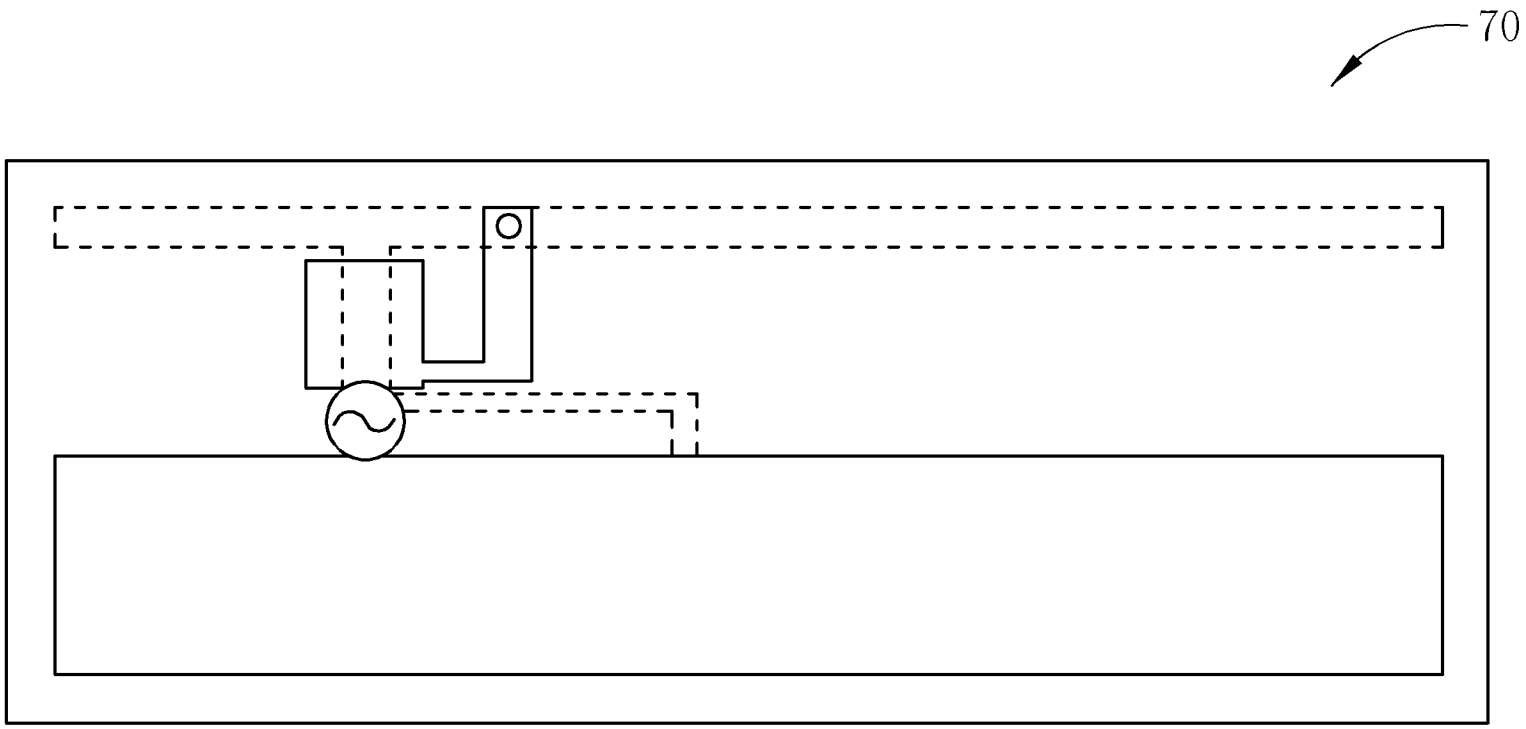
FIG. 7A, FIG. 7B, FIG. 8A, FIG. 8B, FIG. 9A, FIG. 9B, FIG. 10A, FIG. 10B, FIG. 11A, FIG. 11B, FIG. 12A and FIG. 12B are schematic diagrams of antennas and VSWR of the antennas according to different embodiments of the present invention.
Figure 7B:
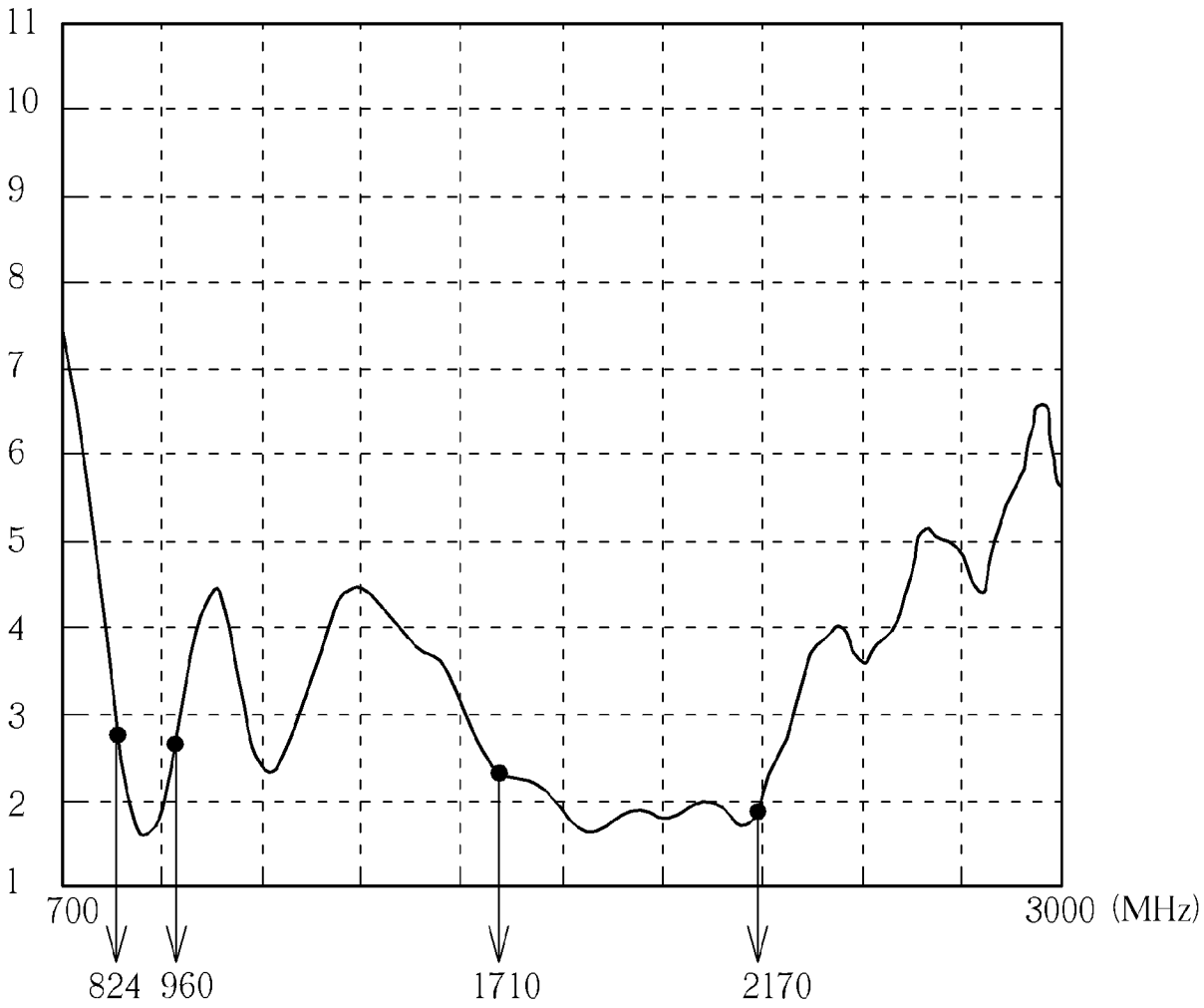
Figure 8A:
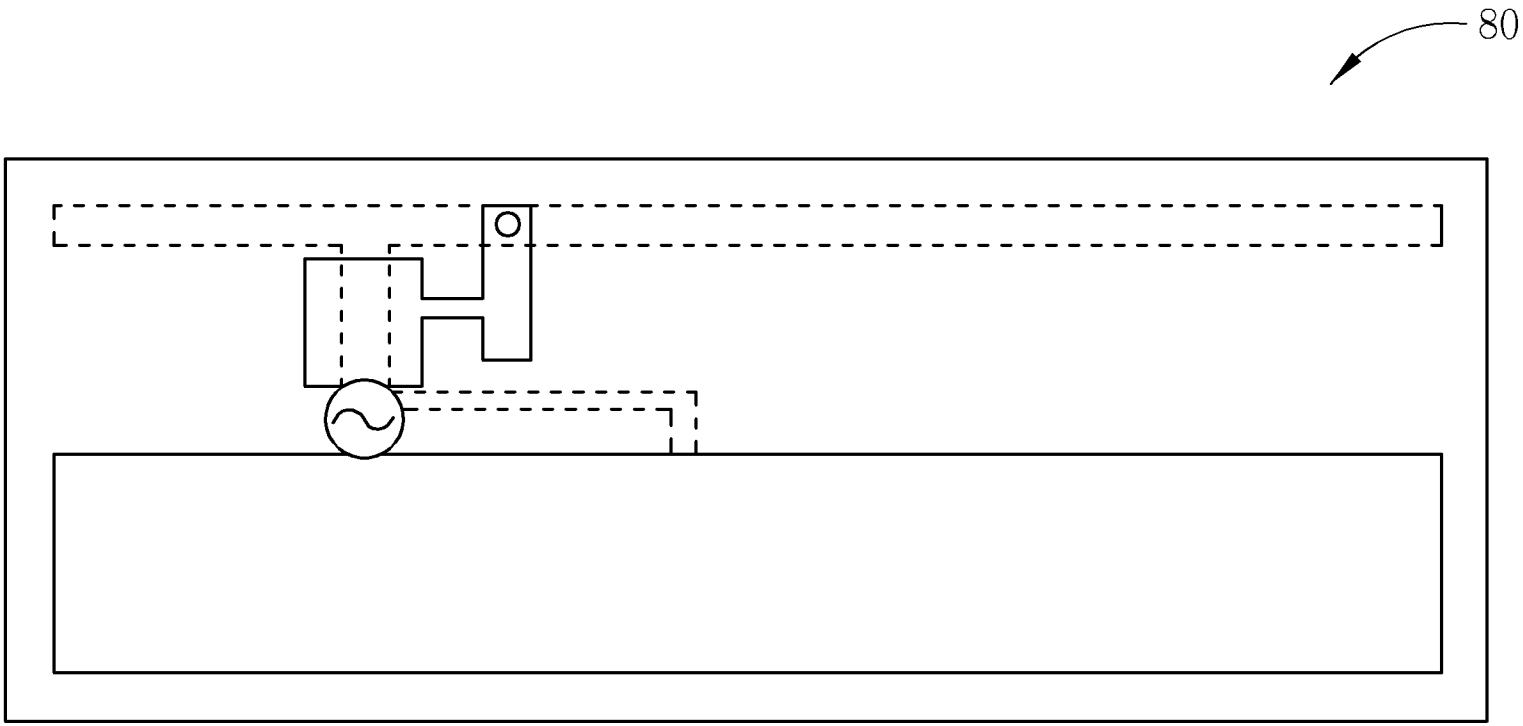
Figure 8B:
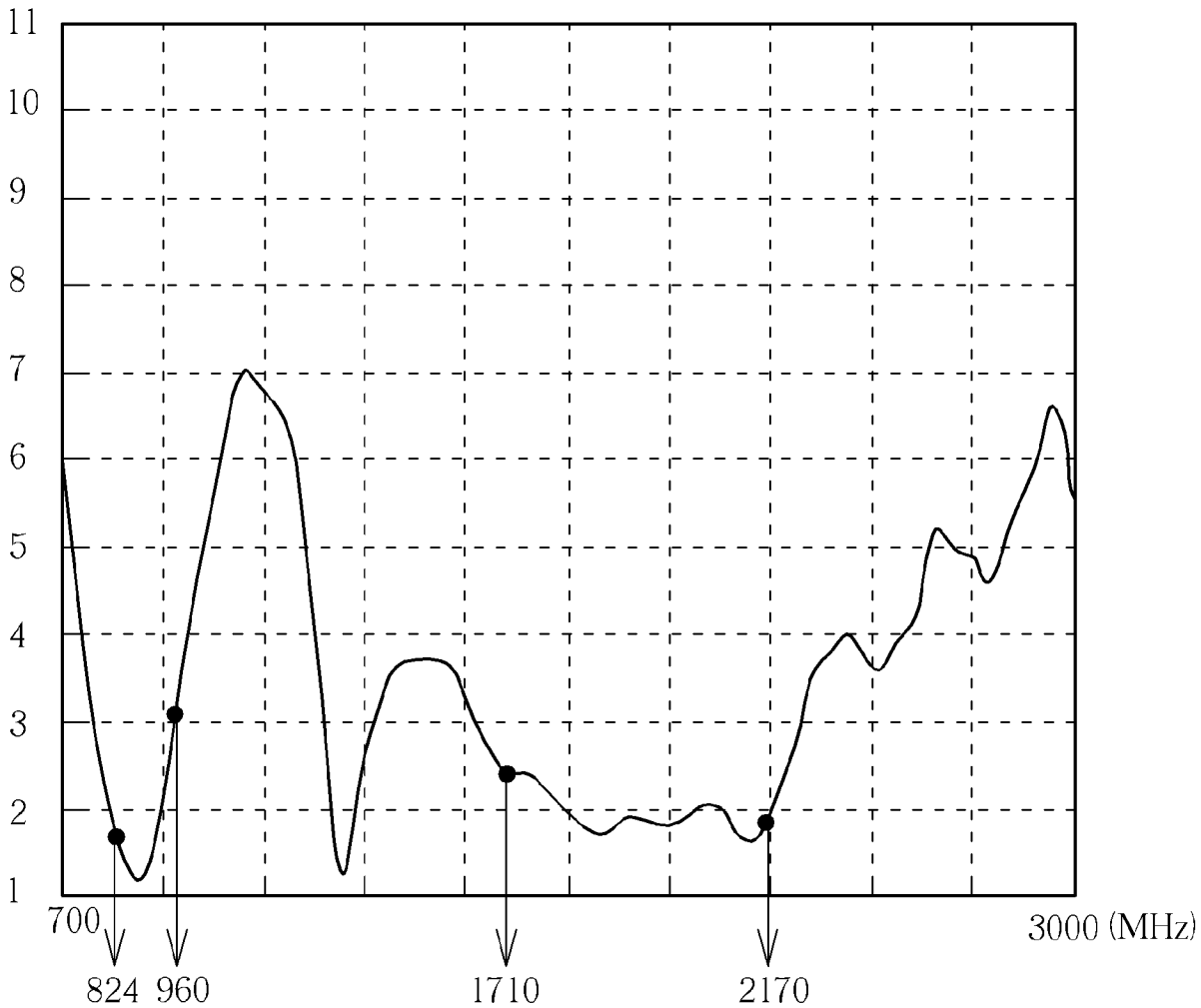
Figure 9A:
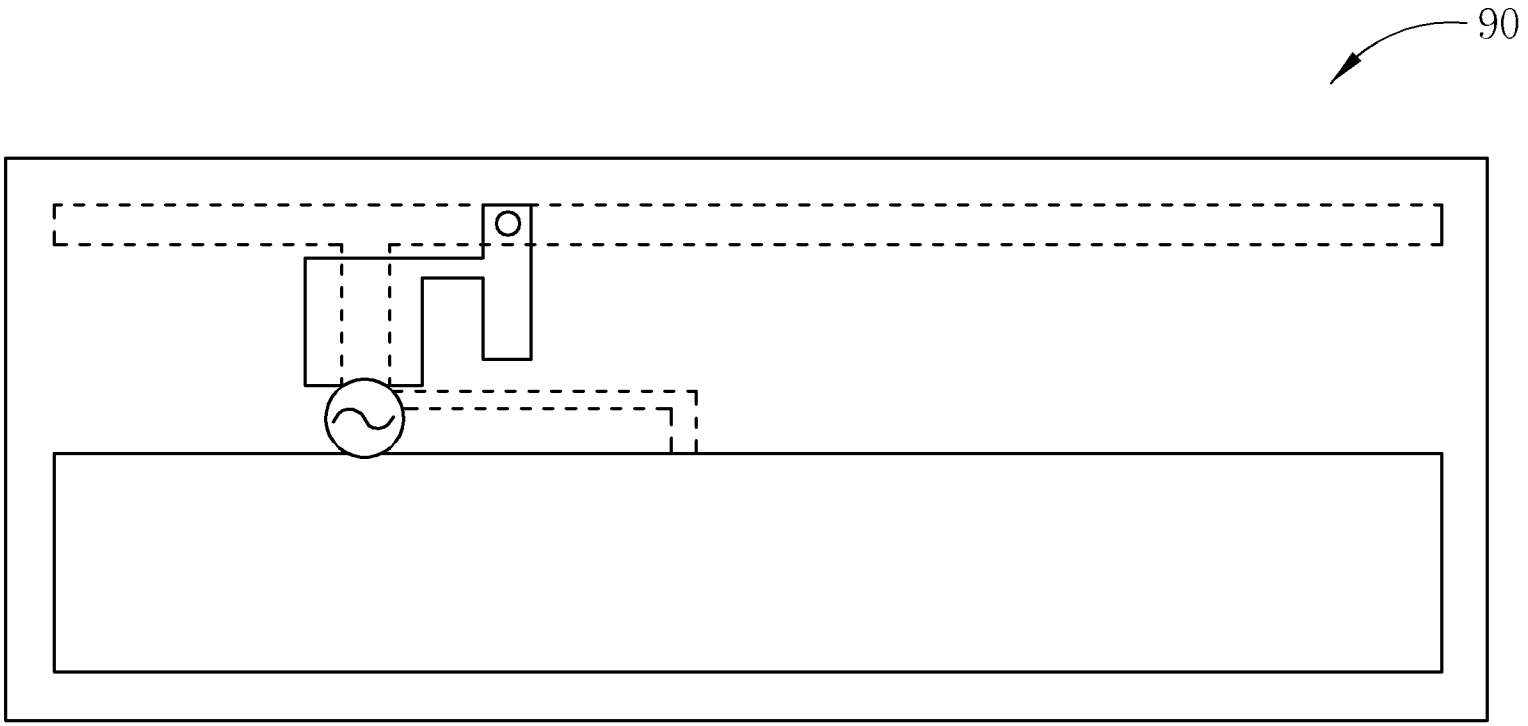
Figure 9B:
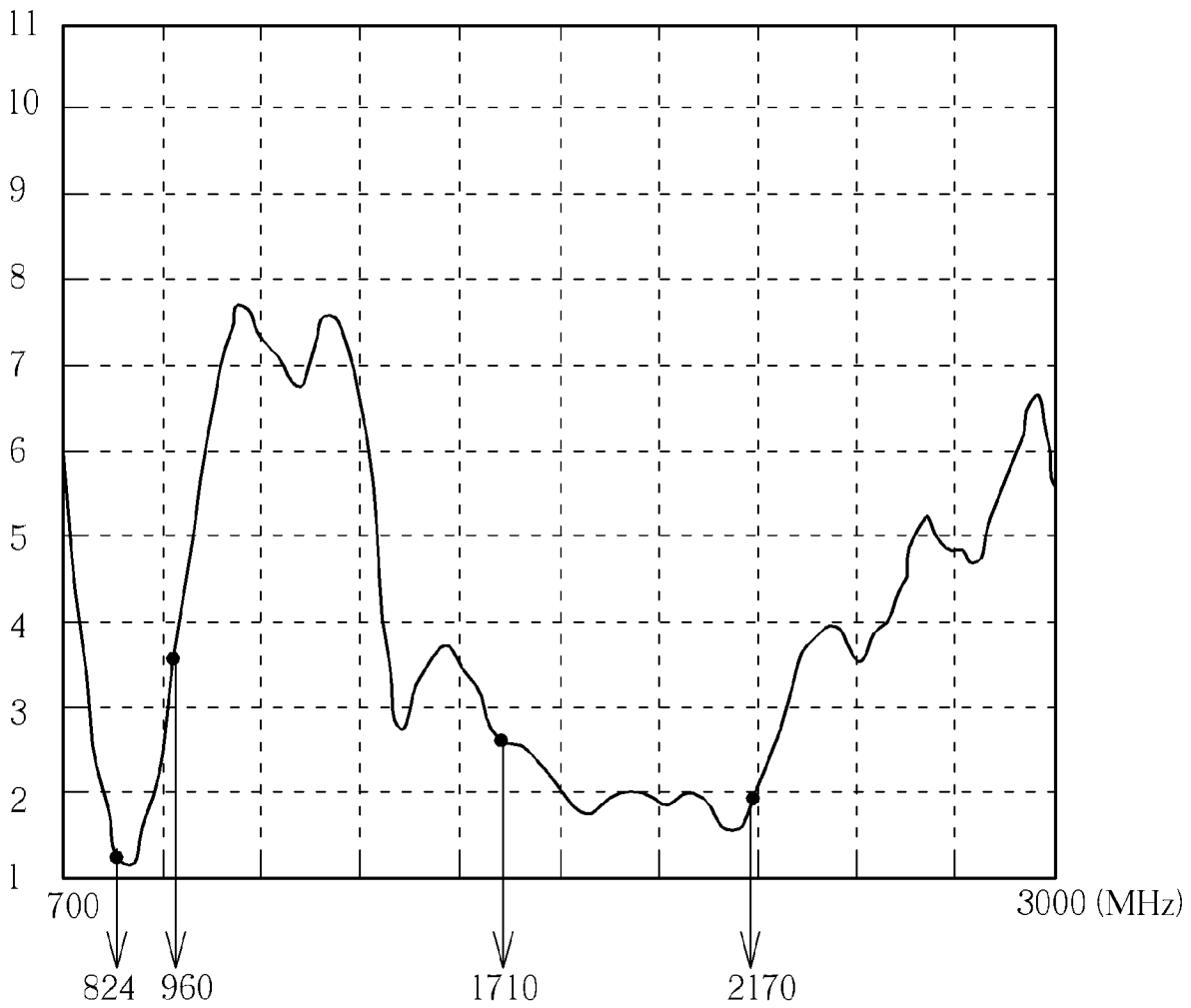
Figure 10A:
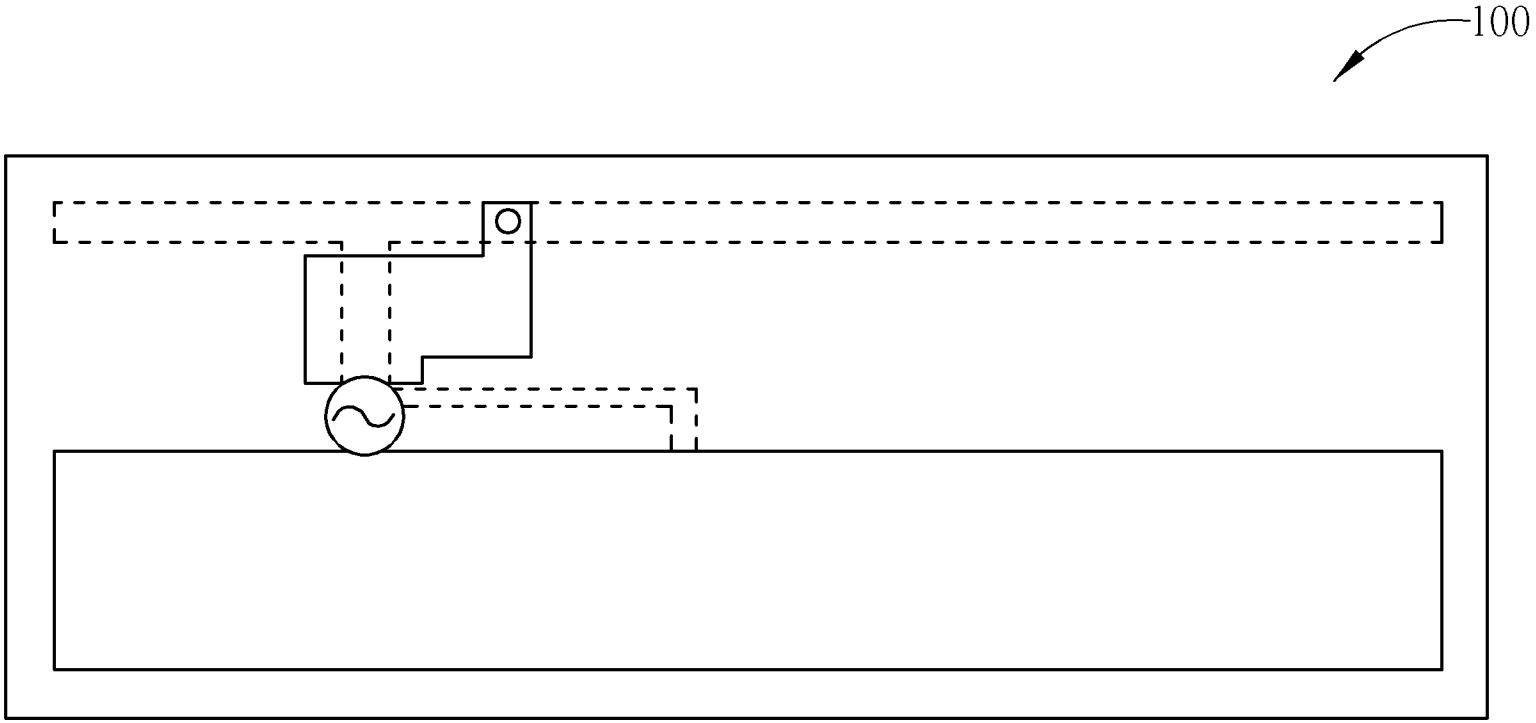
Figure 10B:
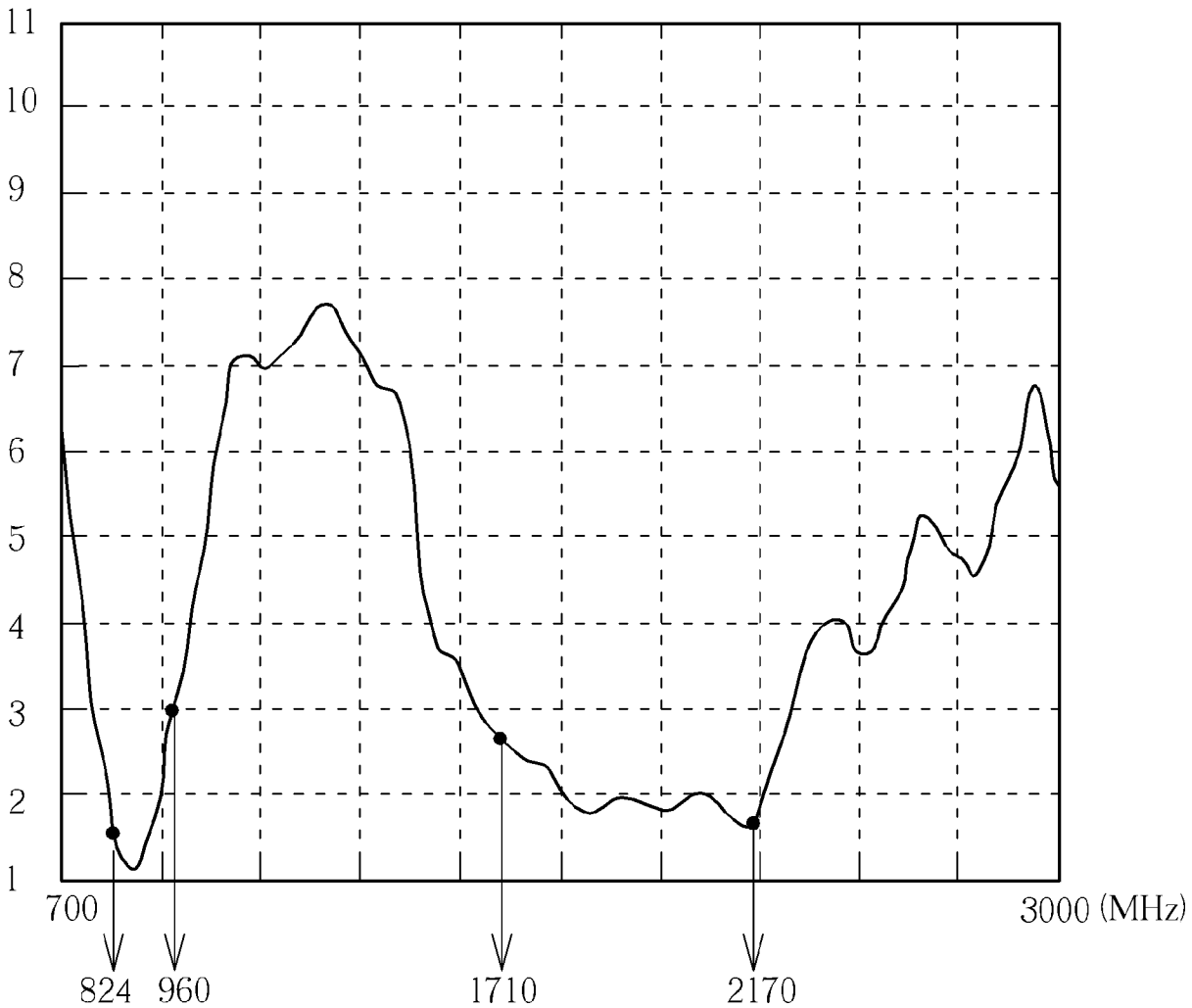

In addition, in FIG. 3A, a shape of the feeding board 310, position of the via 314, etc. also affect the radiation result; therefore, designers can adjust each component in FIG. 3A to conform different system requirements. For example, please refer to FIG. 7A, FIG. 7B, FIG. 8A, FIG. 8B, FIG. 9A, and FIG. 9B. FIG. 7A and FIG. 7B are schematic diagrams of an antenna 70 and VSWR of the antenna 70 respectively. FIG. 8A and FIG. 8B are schematic diagrams of an antenna 80 and VSWR of the antenna 80 respectively. FIG. 9A and FIG. 9B are schematic diagrams of an antenna 90 and VSWR of the antenna 90 respectively. As can be seen from FIG. 7A, FIG. 8A, FIG. 9A, difference among the antenna 70, the antenna 80 and the antenna 90 is a shape of a feeding board; that is, metal strips (equaling the metal strip ML in FIG. 3A) connecting first feeding metal planes and second feeding metal planes are located in low, middle and high positions respectively as shown in FIG. 7A, FIG. 8A and FIG. 9A. Furthermore, as shown in FIG. 7B, FIG. 8B and FIG. 9B, low-frequency parts of the antennas 70, 80 and 90 are mainly affected by the positions of the metal strips, while high-frequency parts thereof are almost unaffected by the positions of the metal strips. Besides, please refer to FIG. 10A and FIG. 10B. FIG. 10A and FIG. 10B are schematic diagrams of an antenna 100 and VSWR of the antenna 100 respectively. Comparing the antenna 70, the antenna 80 and the antenna 90 in FIG. 7A, FIG. 8A and FIG. 9A with the antenna 100 in FIG. 10A, a metal strip of the antenna 100 is wider. As shown in FIG. 10B, the wider metal strip of the antenna 100 mainly affects the low frequency part, but have almost no affection on the high frequency part.

Figure 11A:
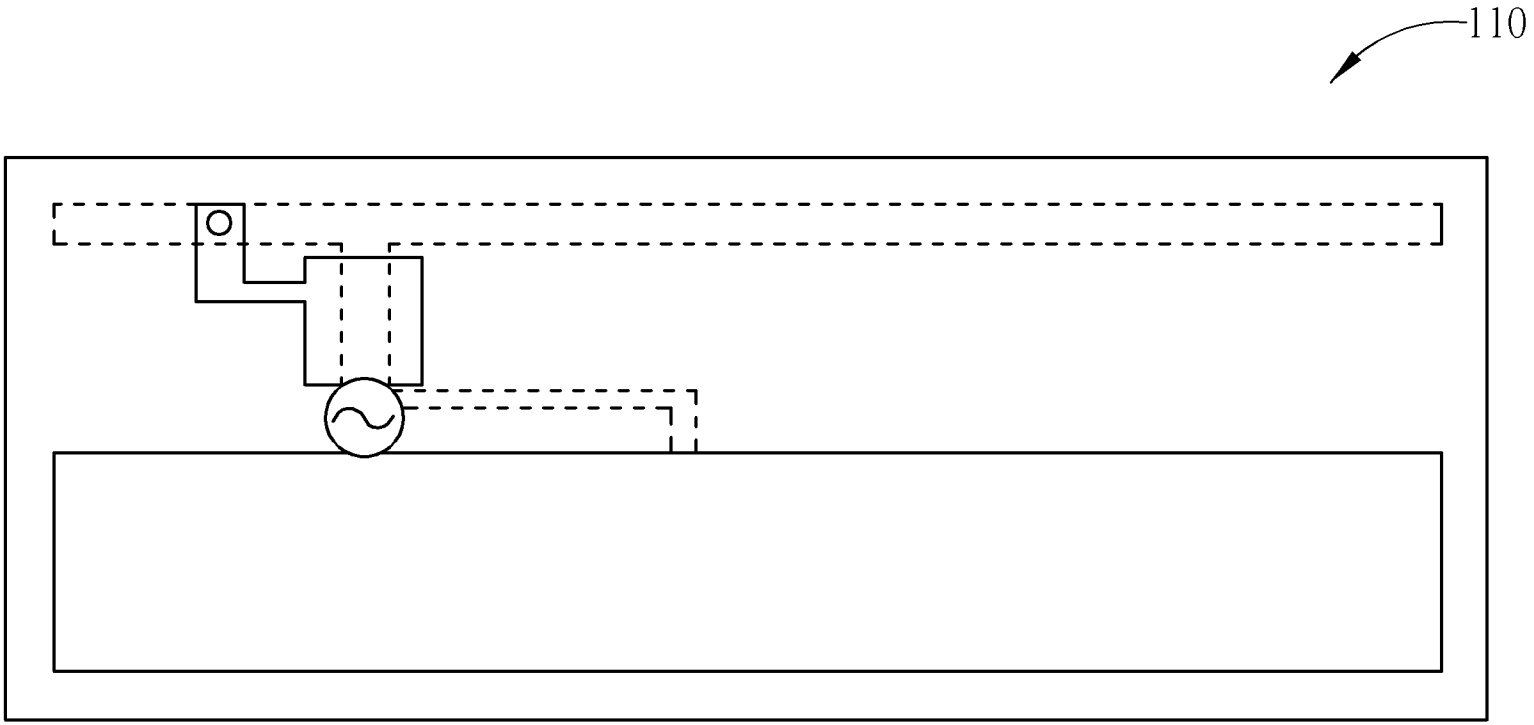
Figure 11B:
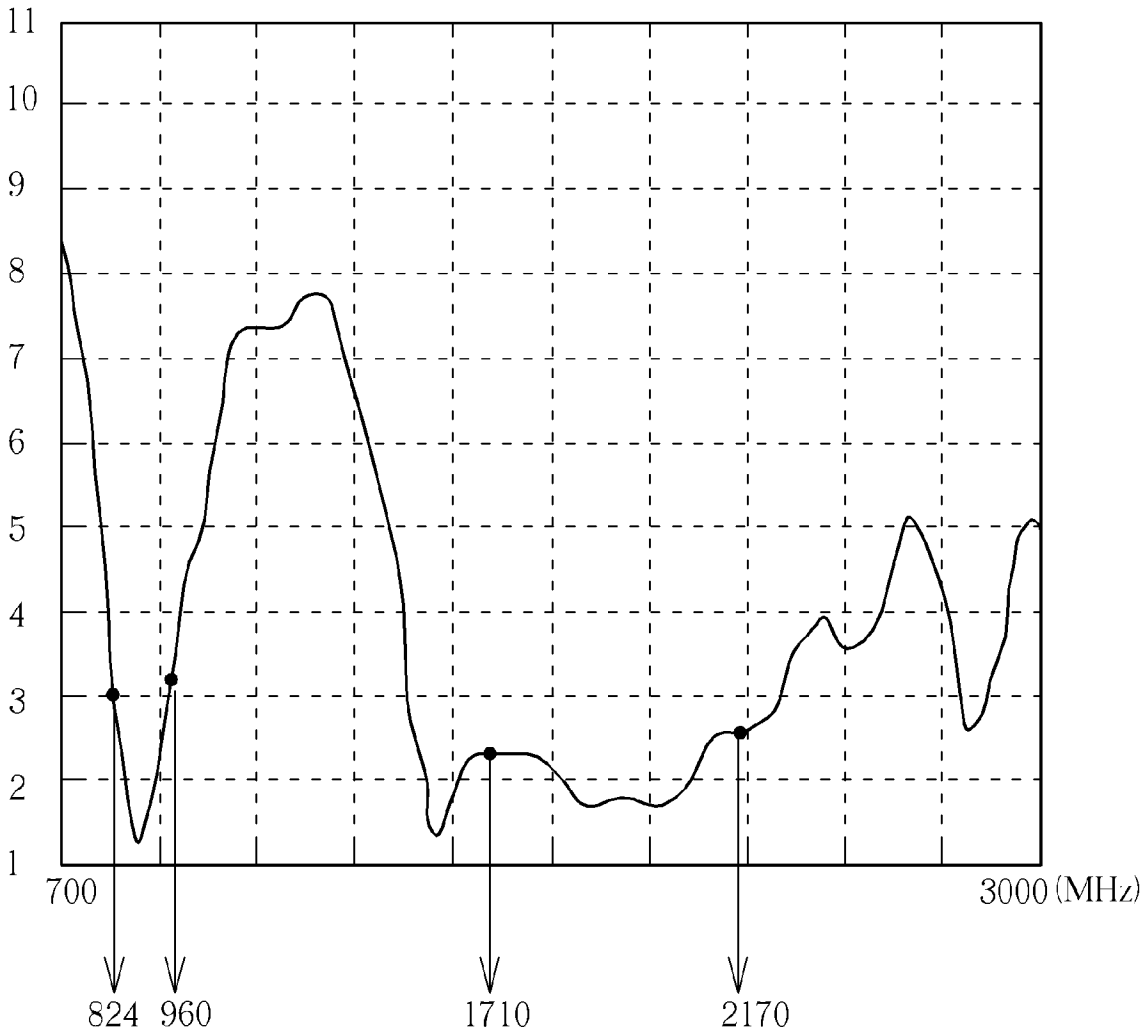
Figure 12A:
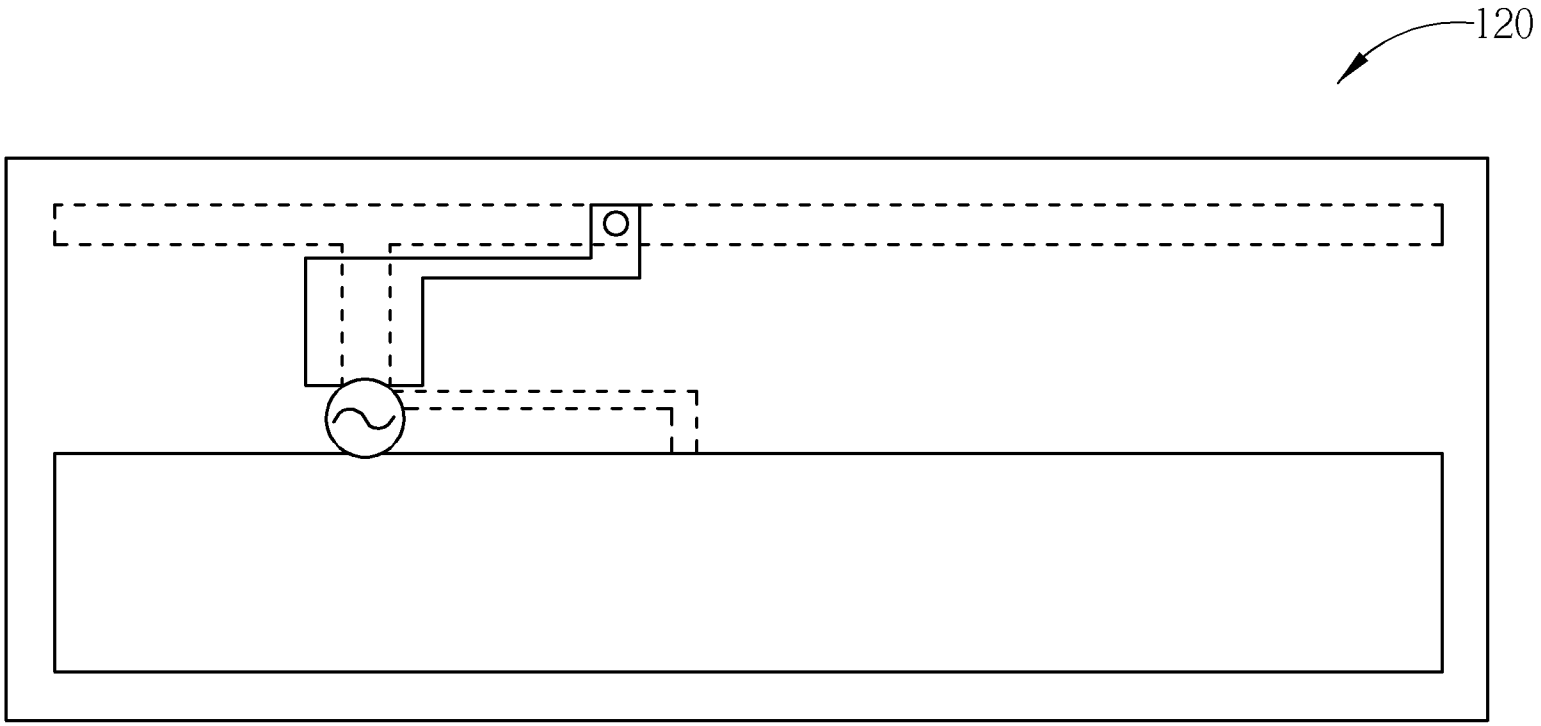
Figure 12B:
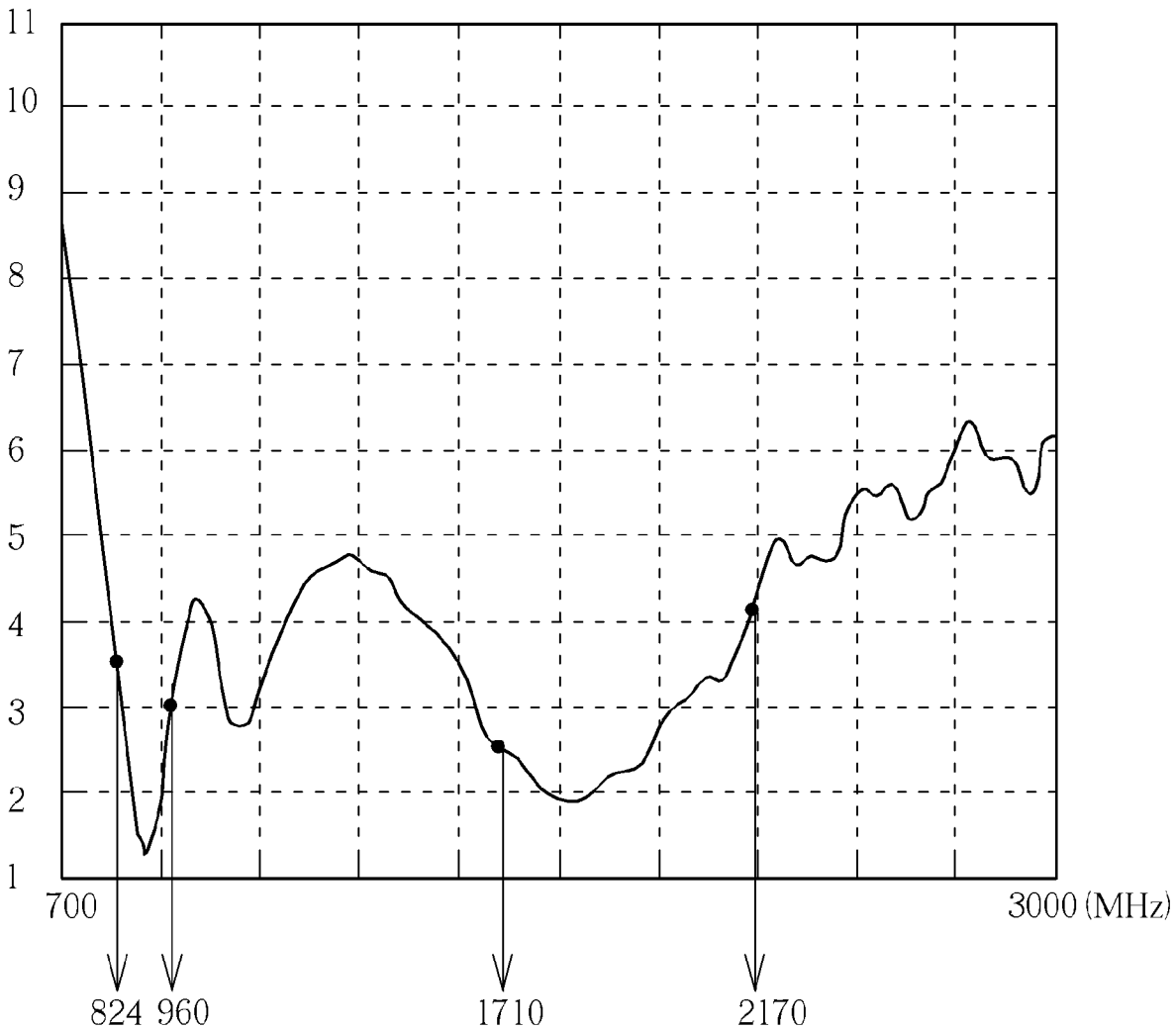

Next, please refer to FIG. 11A, FIG. 11B, FIG. 12A, and FIG. 12B. FIG. 11A and FIG. 11B are schematic diagrams of an antenna 110 and VSWR of the antenna 110 respectively. FIG. 12A and FIG. 12B are schematic diagrams of an antenna 110 and VSWR of the antenna 120 respectively. As shown in FIG. 11A and FIG. 11B, a via (i.e. direct feed-in terminal) can be disposed on the high frequency part, and can also improve bandwidth and matching. As shown in FIG. 12A and FIG. 12B, when a metal strip (equaling the metal strip ML in FIG. 3A), which connects the first feeding metal plane and the second feeding metal plane, is longer, bandwidths of high frequency and low frequency are reduced.

Note that, the abovementioned modifications of the wideband antenna 30 are utilized for describing that the present invention uses both coupling feed-in and direct feed-in methods, and the material, manufacturing method, shape and position of each component, etc. can be altered according to different requirements. With combination of the coupling feed-in and direct feed-in methods, the present invention improves high-frequency bandwidth and low-frequency matching effect, to improve disadvantages of the prior art.

In conclusion, the present invention uses the coupling feed-in method and the direct feed-in method to generate resonation effect, so as to combine the wideband feature of the coupling feed-in method and the well matching feature of the direct feed-in method, to simultaneously improve high frequency bandwidth and low frequency matching.

Those skilled in the art will readily observe that numerous modifications and alterations of the device and method may be made while retaining the teachings of the invention.

What is claimed is:

1. A wideband antenna for a radio transceiver device, comprising:

a first radiating element, extended toward a first direction, for transmitting and receiving wireless signals of a first frequency band;

a second radiating element, extended toward a second direction different from the first direction, for transmitting and receiving wireless signals of a second frequency band, wherein the second frequency band is different from the first frequency band;

a grounding unit;

a shorting unit, having one end electrically connected between the first radiating element and the second radiating element, and another end electrically connected to the grounding unit; and a feeding board, comprising:

a first feeding metal plane element, for transmitting wireless signals of the first frequency band and the second frequency band;

a second feeding metal plane element, electrically connected to the second radiating element, for directly feeding the wireless signals to the first or second radiating element; and a metal strip, electrically connected between the first feeding metal plane element and the second feeding metal plane element;

wherein the first feeding metal plane element is coupled to the shorting unit and is configured at a specific distance from the shorting unit for indirectly feeding the wireless signals to the first or second radiating element, and a result generated by projecting the feeding board on a plane corresponding to the shorting unit partially overlaps the shorting unit and only one of the first radiating element and the second radiating element;

wherein the shorting unit comprises:

a first arm, electrically connected between the first radiating element and the second radiating element, and extending toward the grounding unit;

a second arm, electrically connected to the first arm; and a third arm, electrically connected between the second arm and the grounding unit;

wherein the result generated by projecting the first feeding metal plane element on the plane corresponding to the shorting unit overlaps the first arm partially.

2. The wideband antenna of claim 1, wherein the first feeding metal plane element is coupled to a connection place between the first arm and the second arm.

3. The wideband antenna of claim 1, wherein the second arm extends toward the first radiating element.

4. The wideband antenna of claim 1, wherein the second arm extends toward the second radiating element.

5. The wideband antenna of claim 1 further comprising a substrate, wherein the first radiating element, the second radiating element and the shorting unit are formed on one plane of the substrate, and the feeding board is formed on another plane of the substrate.

6. The wideband antenna of claim 5, wherein the second feeding metal plane element is electrically connected to the second radiating element with a via structure.

* * * * *